US012075902B2

(12) United States Patent
Chamberlayne et al.

(10) Patent No.: US 12,075,902 B2
(45) Date of Patent: Sep. 3, 2024

(54) CARRIER DEVICE FOR MOUNTING AN INPUT DEVICE ON A TORSO OF A PERSON

(71) Applicant: Cotton Carrier Ltd., North Vancouver (CA)

(72) Inventors: Andrew Chamberlayne, North Vancouver (CA); Brook Parker, North Vancouver (CA)

(73) Assignee: COTTON CARRIER LTD., North Vancouver (CA)

( * ) Notice: Subject to any disclaimer, the term of this patent is extended or adjusted under 35 U.S.C. 154(b) by 64 days.

(21) Appl. No.: 17/748,747

(22) Filed: May 19, 2022

(65) Prior Publication Data

US 2022/0369797 A1 Nov. 24, 2022

Related U.S. Application Data

(60) Provisional application No. 63/191,761, filed on May 21, 2021.

(51) Int. Cl.
*A45F 3/14* (2006.01)
*A45F 3/00* (2006.01)

(52) U.S. Cl.
CPC ..... *A45F 3/14* (2013.01); *A45F 2003/003* (2013.01); *A45F 2003/144* (2013.01); *A45F 2003/146* (2013.01)

(58) Field of Classification Search
CPC ..... A45F 3/14
(Continued)

(56) References Cited

U.S. PATENT DOCUMENTS 2,130,262 A 9/1938 Moritz
2,723,430 A 11/1955 Gaston
(Continued)

FOREIGN PATENT DOCUMENTS

CA 2652509 C 7/2016
CA 2930007 C 12/2021
(Continued)

OTHER PUBLICATIONS

Printout from https://peakdesignltd.com/capture/Date of publication is unknown to Applicant.

*Primary Examiner* — Nathan J Newhouse
*Assistant Examiner* — Lester L Vanterpool
(74) *Attorney, Agent, or Firm* — Nicholas Garner; Oyen Wiggs Green & Mutala LLP

(57) ABSTRACT

There is provided a carrier device for mounting a drone controller on a torso of a person. The carrier device includes a torso plate and adjustment straps that position the torso plate in along a front middle portion of a person's torso. The carrier device includes a first of a first female connector and a first male connector coupled to the torso plate. The carrier device includes an elongate mount with a second of the first female connector and the first male connector coupled thereto. The elongate mount selectively couples to the torso plate via the first female and male connectors. The elongate mount includes a first of a second female connector and a second male connector. The carrier device includes a second of the second female connector and the second male connector connectable to the drone controller. The elongate mount selectively couples to the drone controller via the second female and male connectors.

20 Claims, 20 Drawing Sheets

(58) Field of Classification Search
USPC ..... 224/623
See application file for complete search history.

(56) References Cited

U.S. PATENT DOCUMENTS

| | | | | |
|---|---|---|---|---|
| 2,990,089 | A | 6/1961 | Nystrom | |
| 3,884,403 | A | 5/1975 | Brewer | |
| 3,938,166 | A | 2/1976 | Sloop | |
| 4,058,242 | A | 11/1977 | Brewer | |
| 4,328,917 | A | 5/1982 | Reeberg | |
| 4,416,405 | A | 11/1983 | Caillouet | |
| 4,419,794 | A | 12/1983 | Horton, Jr. et al. | |
| 4,461,411 | A | 7/1984 | Harrow | |
| 4,473,177 | A | 9/1984 | Parandes | |
| 4,714,184 | A | 12/1987 | Young et al. | |
| D307,286 | S | 4/1990 | Ginder | |
| 5,014,892 | A * | 5/1991 | Copeland | A45F 5/021 224/678 |
| 5,172,838 | A | 12/1992 | Rowell et al. | |
| 5,251,800 | A | 10/1993 | Leenders | |
| 5,375,749 | A | 12/1994 | Oliva | |
| 5,612,756 | A * | 3/1997 | Kardach | F16M 11/048 396/422 |
| 5,620,120 | A * | 4/1997 | Tien | H04M 1/04 224/904 |
| 5,850,954 | A | 12/1998 | Dong-Joo | |
| 5,850,996 | A | 12/1998 | Liang | |
| 6,019,326 | A * | 2/2000 | Baerwolf | F16M 11/048 396/432 |
| 6,601,999 | B1 | 8/2003 | McTeer | |
| 6,905,051 | B2 | 6/2005 | Chee | |
| 7,128,354 | B2 * | 10/2006 | Wu | F16M 13/04 396/419 |
| 7,162,281 | B2 | 1/2007 | Kim | |
| 7,624,901 | B1 | 12/2009 | Mozes | |
| 7,980,771 | B2 * | 7/2011 | Chamberlayne | G03B 17/561 396/423 |
| 8,075,202 | B1 | 12/2011 | Chamberlayne | |
| 8,292,521 | B2 | 10/2012 | Chamberlayne | |
| 8,573,865 | B2 * | 11/2013 | Chamberlayne | F16M 11/041 396/419 |
| 8,708,583 | B2 | 4/2014 | Chamberlayne | |
| 2003/0098323 | A1 | 5/2003 | Taylor et al. | |
| 2004/0200867 | A1 | 10/2004 | Chee | |
| 2006/0204240 | A1 | 9/2006 | Cameron et al. | |
| 2008/0240705 | A1 * | 10/2008 | Nazarian | F16M 11/24 396/420 |
| 2009/0196596 | A1 | 8/2009 | Chamberlayne | |
| 2010/0054724 | A1 | 3/2010 | Chamberlayne | |
| 2010/0098404 | A1 | 4/2010 | Inoue | |
| 2011/0142436 | A1 | 6/2011 | Eynav | |
| 2011/0243544 | A1 | 10/2011 | Chamberlayne | |
| 2014/0246468 | A1 * | 9/2014 | Montgomery | B60R 11/0229 224/548 |
| 2016/0236626 | A1 * | 8/2016 | Yialamas | B60R 11/02 |

FOREIGN PATENT DOCUMENTS

| | | | |
|---|---|---|---|
| GB | 871489 | A | 6/1961 |
| JP | 2000321655 | A | 11/2000 |
| JP | 2003116621 | A | 4/2003 |
| WO | 1983001370 | A1 | 4/1983 |
| WO | 1997036516 | A1 | 10/1997 |
| WO | 2009039292 | A1 | 3/2009 |

* cited by examiner

CARRIER DEVICE FOR MOUNTING AN INPUT DEVICE ON A TORSO OF A PERSON

CROSS REFERENCE TO RELATED APPLICATIONS

This application is a non-provisional of U.S. Provisional Patent Application No. 63/191,761 filed in the United States Patent and Trademark Office on 21 May 2021, and the disclosure of which is incorporated herein by reference and priority to which is claimed.

BACKGROUND OF THE INVENTION

Field of the Invention

There is provided a carrier device. In particular, there is provided a carrier device for mounting an input device on a torso of a person.

Description of the Related Art

U.S. Pat. No. 7,980,771 to Chamberlayne discloses a device for rotatably mounting a camera on a person comprises first and second connecting means. The first connecting means has a U-shaped slot which is defined by a pocket and a pair of opposed channels which extend from the pocket. The second connecting means has a plate and a truncated cylindrical body mounted on the plate. The plate is slidably received by the U-shaped slot and is rotatable within the U-shaped slot. The truncated cylindrical body is provided with a flat edge. A threaded member extends from one of said first connecting means or said second connecting means. The threaded member is for engaging a threaded female tripod receiver of the camera. The plate of the second connecting means can only be received or released from the U-shaped slot of first connecting means when the flat edge to the truncated cylindrical body of the second connecting means is aligned with one of said opposed channels of the first connecting means.

U.S. Pat. No. 8,075,202 to Chamberlayne discloses a device for rotatably mounting a camera on a person. The device includes a female connector and a male connector. The female connector has a U-shaped slot defined by a pocket and a pair of opposed channels which extend from the pocket. The male connector has a wedge shaped base, a plate spaced-apart form the base, and an opening extending through the wedge shaped base and the plate. The plate is slidably received by the U-shaped slot of the female connector and rotatable through 360 degrees within the pocket of the female connector. A threaded member extends through the opening in the male connector. The threaded member is for engaging a threaded tripod receiver of the camera. A strap assembly is connected to the female connector. The strap assembly is for mounting the device to the person. The plate of the male connector has a first rotatable position within the pocket of the female connector in which the male connector is secured to the female connector, and a second rotatable position within the pocket of the female connector in which the male connector is releasable from the female connector.

U.S. Pat. No. 8,708,583 to Chamberlayne discloses a device for rotatably mounting a camera on a person carrying a bag. The device includes a body with lateral flaps on opposite sides thereof. The lateral flaps are foldable along lines of weakness to allow the device to hug a strap of the bag. A female connector is disposed on the body and has a U-shaped slot defined by a curved pocket and a pair of opposed channels which extend from the pocket. The male connector has a plate and threaded member extending from the plate. The threaded member is for engaging a threaded female tripod receiver of the camera extending from the plate. The plate is slidably received by the U-shaped slot of the female connector and the plate is freely rotatable within the U-shaped slot of the female connector.

BRIEF SUMMARY OF INVENTION

There is provided, and it is an object to provide, an improved carrier device for mounting an input device on a torso of a person.

There is accordingly provided a device for mounting an input device on a torso of a person. The device includes a plurality of straps. The device includes a jacket connected to the plurality of straps so as to position the jacket substantially in a front middle portion of the torso of the person. The device includes a first of a first female connector and a first male connector coupled to the jacket. The device includes an elongate mount with a second of the first female connector and the first male connector coupled thereto. The elongate mount selectively couples to the jacket via the first female connector and the first male connector. The elongate mount includes a first of a second female connector and a second male connector. The device includes a second of the second female connector and the second male connector. The second of the second female connector and the second male connector is connectable to the input device. The elongate mount selectively couples to the input device via the second female connector and the second male connector.

There is also provided a carrier device for mounting an input device on a torso of a person according to another aspect. The device includes an elongate mount with a first of a female connector and a male connector at a first portion thereof. The device includes a torso plate positioned in place via a strap assembly. The torso plate includes a second of the female connector and the male connector coupled thereto. The elongate mount is selectively connectable to the torso plate via the connectors. The device includes a female member connectable via adhesive to the input device. The female member slidably couples with a second portion the elongate mount.

There is further provided a carrier device for coupling an input device to a torso of a person. The carrier device includes a body plate to which positionable in place along the torso of the person via a strap assembly. The device includes a female connector with a plate connectable to the input device via adhesive. The female connector includes opposed channels coupled to and integrally formed with the plate thereof. The device includes an elongate mount selectively connectable to the body plate. The elongate mount includes an elongate member shaped to be slidably received within the channels of the female connector.

There is additionally provided a carrier device for coupling an input device to a torso of a person. The carrier device includes a female connector with a plate connectable to the input device via adhesive. The female connector includes opposed channels coupled to and integrally formed with the plate thereof. The device includes an elongate mount selectively connectable to the body plate via a first portion thereof. The elongate mount includes an elongate member shaped to be slidably received within the channels of the female connector. The device includes a threaded member. Actuation of the threaded member further couples together the female connector and the elongate member, and inhibits movement of the female connector relative to the elongate member.

There is further provided a carrier device for mounting an input device on a torso of a person according to another aspect. The carrier device includes a jacket positionable along the torso of the person. The carrier device includes an elongate mount shaped to selectively couple to the jacket via a first female connector and a second male connector. The elongate mount is shaped to slidably couple to the input device via a second female connector and a second male connector.

BRIEF DESCRIPTION OF DRAWINGS

The accompanying drawings illustrate non-limiting example embodiments of the invention.

DESCRIPTION OF THE PREFERRED EMBODIMENTS

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
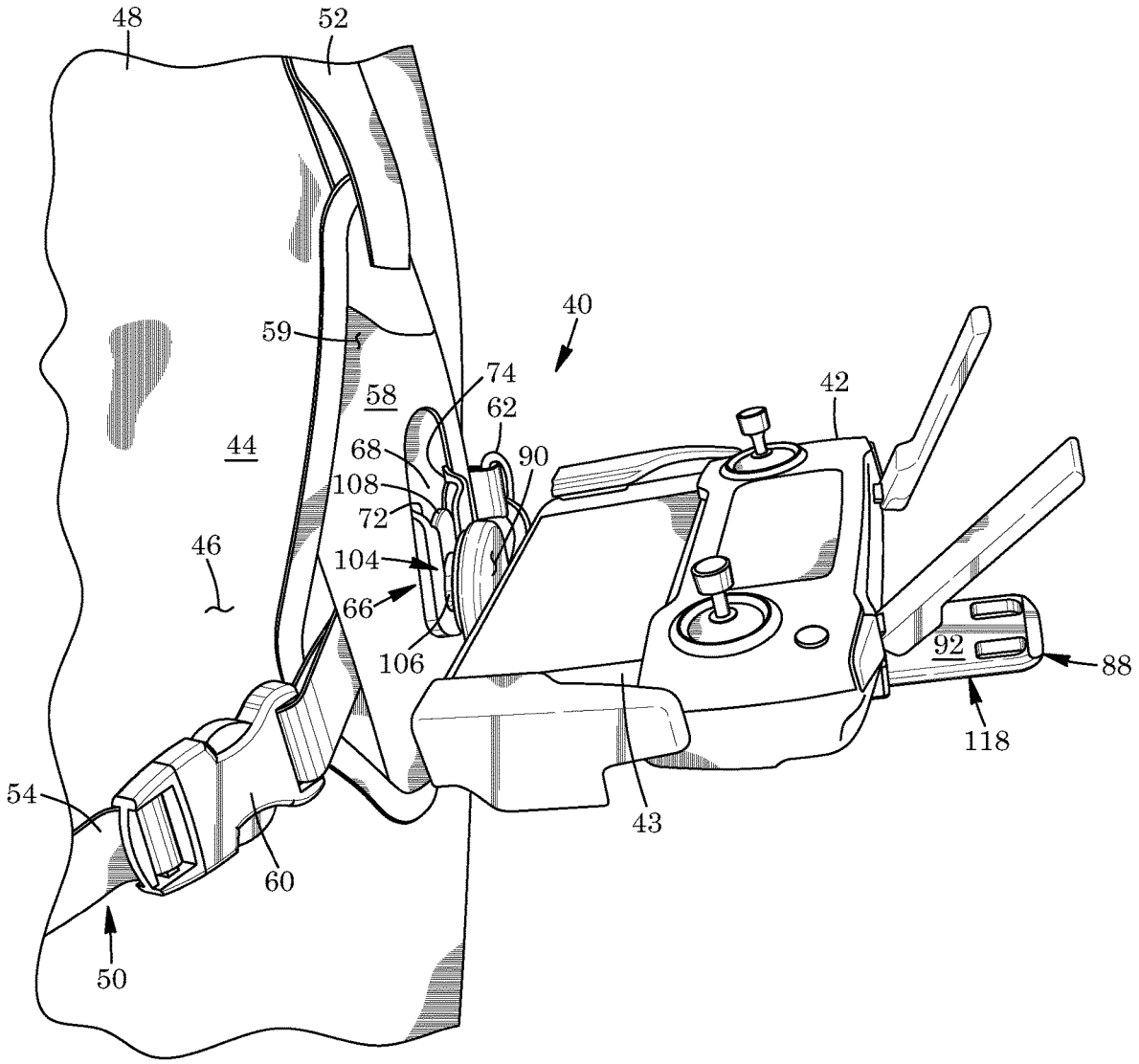
FIG. 1 is a right side, top, front perspective view of a carrier device together with an input device coupled to a person shown in fragment, in this example a drone controller coupled thereto, the carrier device including a strap assembly shown in fragment and a torso plate positioned via the strap assembly on a front middle portion of a torso of the person, with the carrier device further including an elongate mount upon which the drone controller extends.

Referring to the drawings and first to FIG. 1, there is shown a carrier device 40 for mounting to a person 48 an input device, in this example an electronic device, in this case a controller, in this instance a drone controller 42. The carrier device in this example is configured to mount the controller on a front middle portion 44 of a torso 46 of the person. Drone controller 42 includes a processor or computer, in this example a smart phone 41 coupled thereto. In other embodiments the input device may be another object or traditionally handheld electronic device, such as a gaming controller, a tablet, a computer, a smart phone on its own and/or a touch-screen monitor, for example.

Figure 2:
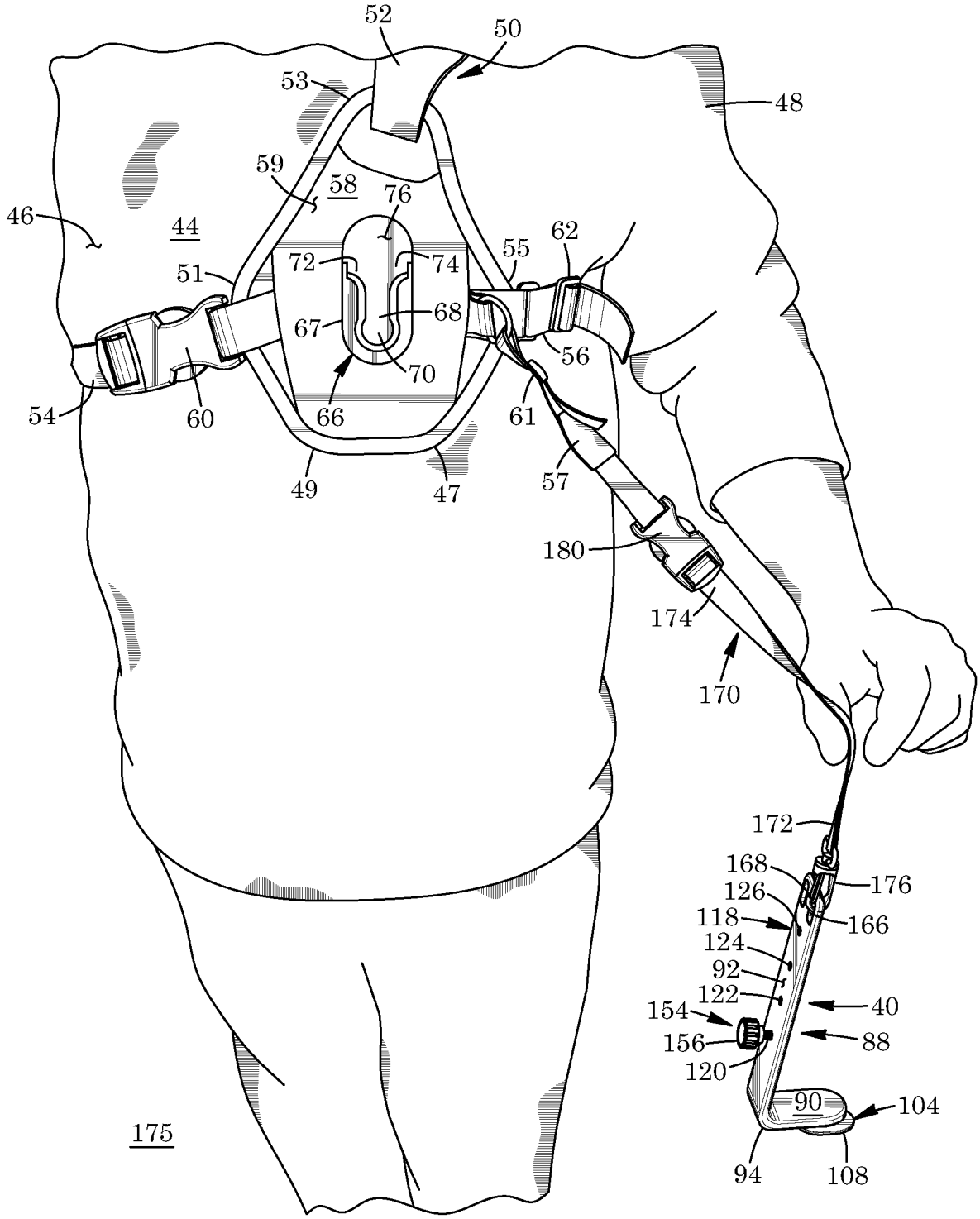
FIG. 2 is a front perspective view of the carrier device and person of FIG. 1, with the elongate mount of the carrier device shown spaced-apart from the torso plate of the carrier device and coupled to the torso plate via a safety tether, and with the person and adjustment straps of the carrier device shown in fragment.

As seen in FIG. 2, the carrier device includes a strap assembly 50. The strap assembly includes a plurality of adjustable straps, in this example one or more shoulder straps 52, one or more side straps 54 and 56, and a peripheral strap 57. The shoulder straps extend about the person's shoulders and the side straps extend about the person's torso. Shoulder strap 52 and side straps 54 and 56 couple together along the back of the person in this example; however, this is not strictly required. For example, instead of a plurality of straps, there may be provided a sling type harness. The sling-type harness may comprise two straps that selectively couple together and extend about one shoulder adjacent a first side of the person towards the rear thereof, diagonally along the back of the person and along a second side and towards the front thereof adjacent the person's hips for example.

Figure 3:
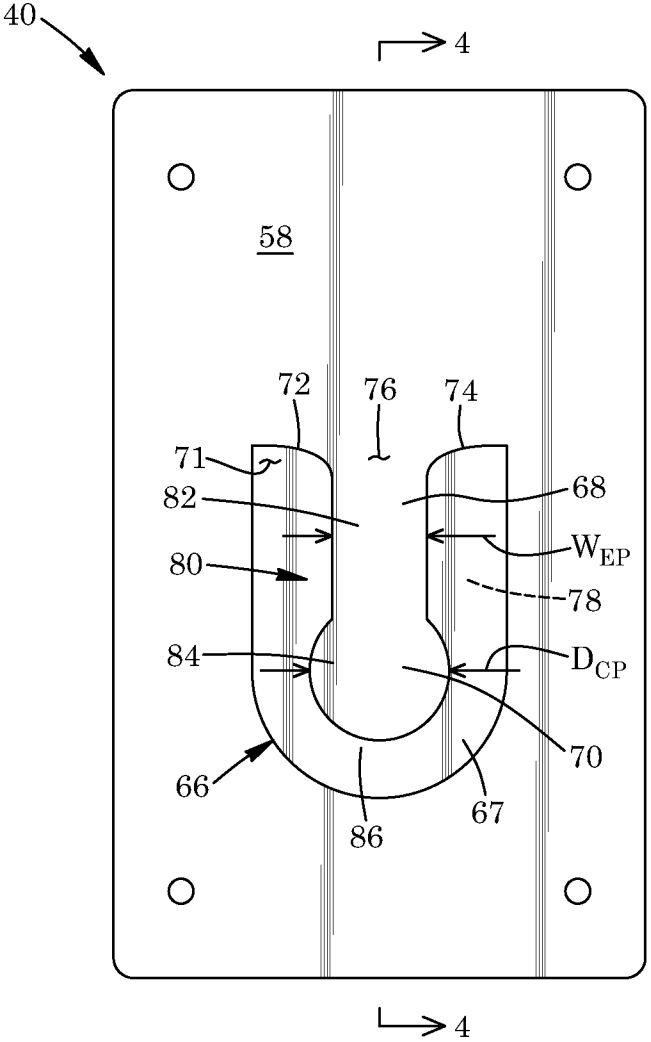
FIG. 3 is a front elevation view of the torso plate of the carrier device of FIG. 1, together with a first female connector of the carrier device shown coupled thereto.

Referring to FIG. 1, the carrier device 40 includes a planar member, in this example a body plate, in this case a torso plate 58. As seen in FIG. 3, the torso plate is rectangular in this example, though this is not strictly required. Torso plate 58 is enclosed by a jacket 59 seen in FIG. 1. The torso plate may be said to be part of the jacket. Jacket 59 is made of fabric in this example, though this is not strictly required. As seen in FIG. 2, the jacket is an elongate pentagon in front profile in this example with rounded vertices 47, 49, 51, 53 and 55; however this is not strictly required. Sides straps 54 and 56 couple to jacket 59 via side vertices 51 and 55 in this example. Peripheral strap 57 couples to the jacket via side vertex 55. Shoulder strap 52 couples to jacket 59 via upper vertex 53 in this example. Torso plate 58 is thus positioned in place via straps 52, 54 and 56.

Figure 20:
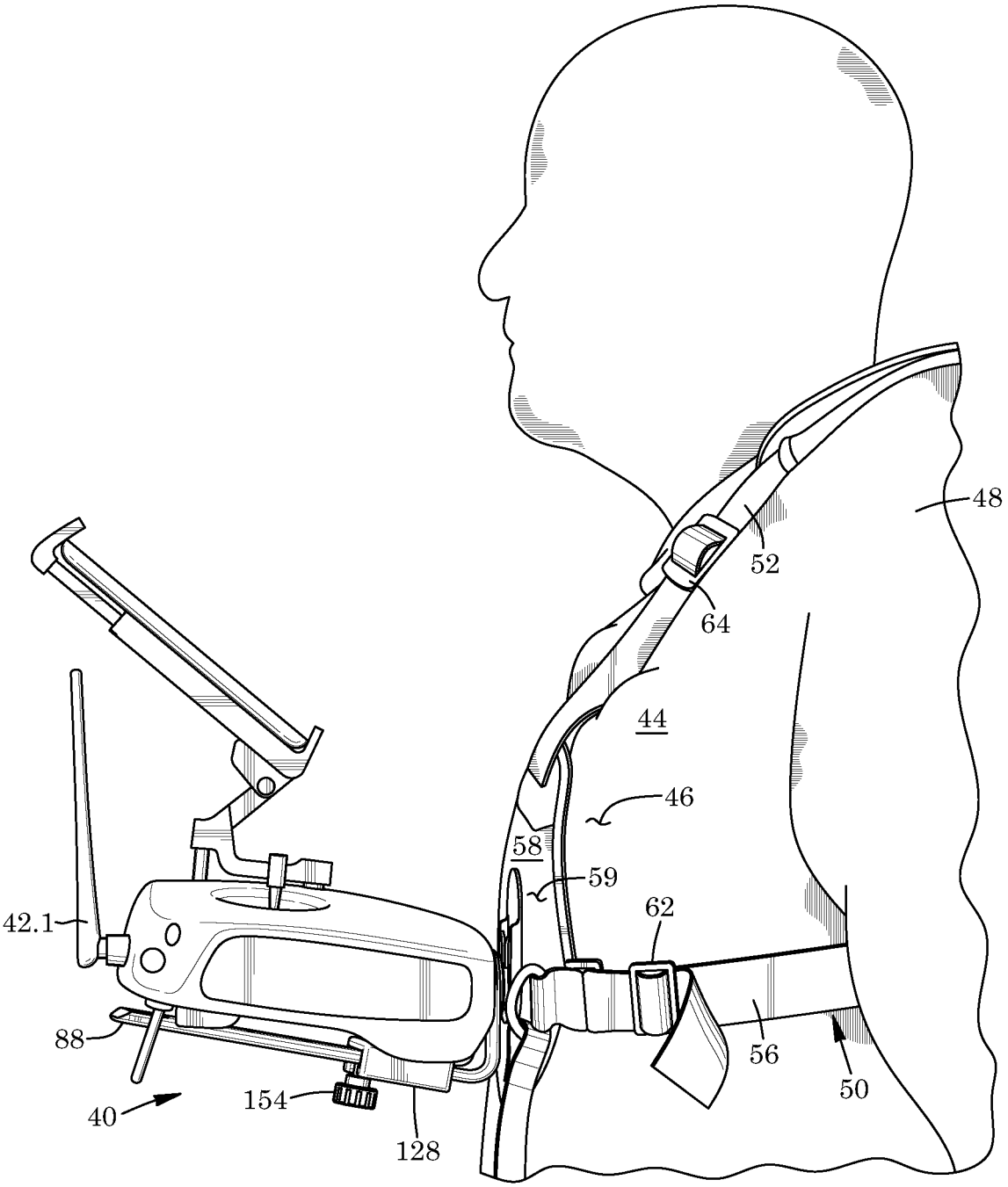
FIG. 20 is a left side perspective view of the carrier device of FIG. 1 with the drone controller of FIG. 18 shown coupled thereto, together with a person to which the carrier device is mounted via the strap assembly of the carrier device, with the strap assembly and person being shown in fragment.

The side straps position the torso plate and jacket 59 substantially in front middle portion 44 of torso 46 of person 48. Strap assembly 50 includes in this example a first connector, in this example a quick release buckle 60 via which side strap 54 couples to torso plate 58. As seen in FIG. 20, the strap assembly includes one or more length adjustment mechanisms, in this example slip locks 62 and 64. The slip locks enable the effective lengths of straps 52 and 56 to be selectively adjusted. Referring back to FIG. 2, peripheral strap 57 also includes a slip lock 61 that enables the effective length thereof to be adjusted. Quick release buckles and slip locks, including their parts and functionings thereof, are known to those skilled in the art and will therefore not be described in further detail.

Still referring to FIG. 2, carrier device 40 includes a first of a first female connector and a first male connector coupled to torso plate 58, in this example first female connector 66. The first female connector is mounted on person 48 via strap assembly 50. As seen in FIG. 3, first female connector 66 may be said to comprise a hollow u-shaped protrusion 67 protruding from a portion 76 of torso plate 58. The first female connector is integrally formed with and connected to the torso plate so as to form an unitary whole in this example.

Figure 4:
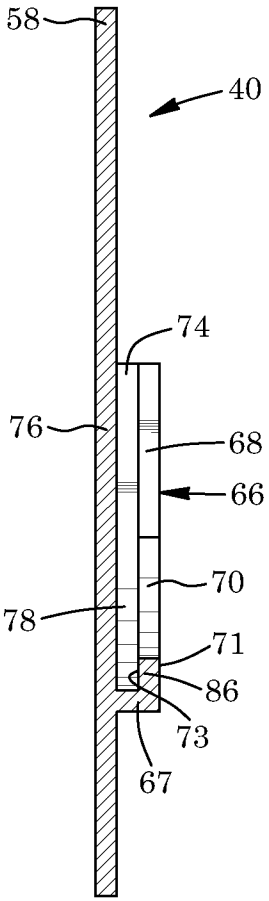
FIG. 4 is a sectional view taken along lines 4-4 of the torso plate and first female connector of the carrier device of FIG. 3.
Figure 12:
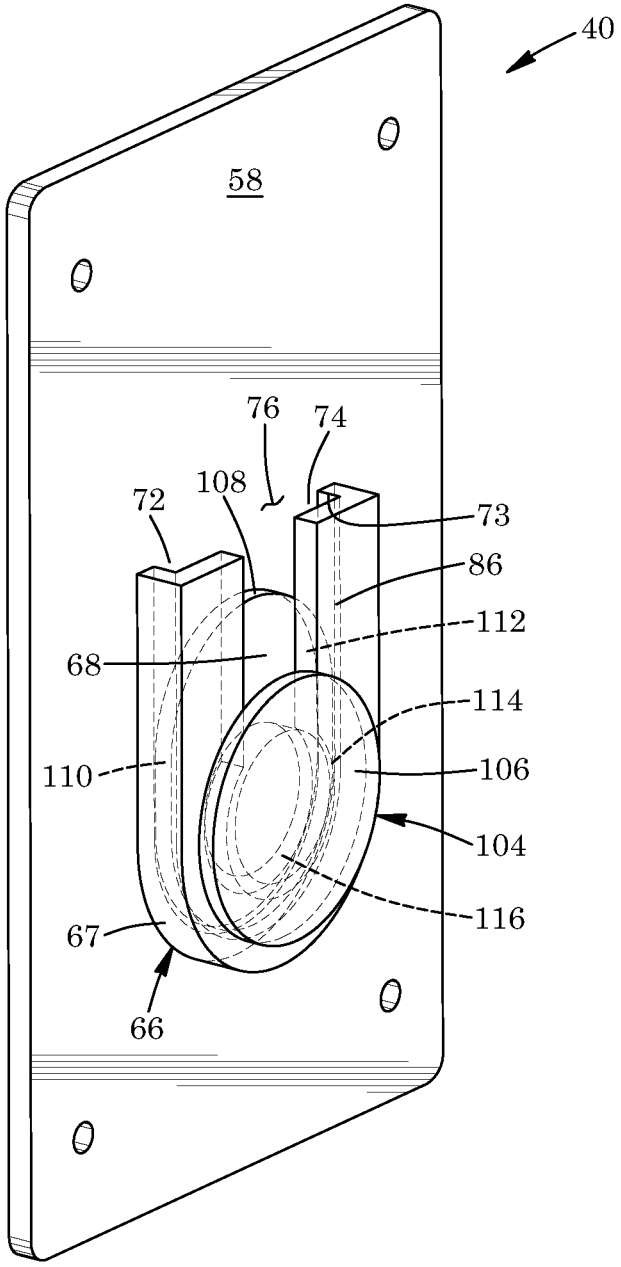
FIG. 12 is a right side, front, top perspective view of the torso plate and first female connector of the carrier device of FIG. 1, together with the first male connector of the carrier device shown received within the first female connector, and with the rest of the elongate mount of the carrier device not being shown.

First female connector 66 has a U-shaped slot 68 defined by a curved pocket 70 and a pair of opposed channels 72 and 74 which extend from the pocket. The opposed channels couple to and are integrally formed with torso plate 58 in this example. As seen in FIG. 12, channel 72 so coupled to the torso plate forms a C-shaped in lateral section and channel 74 so coupled to the torso plate forms a reverse C-shaped in lateral section in this example. Referring to FIG. 3, the channels have exterior surfaces 71. As seen in FIG. 4, channels 72 and 74 have interior surfaces 73 opposite the exterior surfaces thereof.

Referring to FIG. 3, pocket 70 and the channels define a u-shaped receptacle 78. First female connector 66 has a bulb-shaped opening 80 in this example defined by an elongate portion 82 and a circular portion 84. The elongate portion has a width $W_{EP}$ extending between channels 72 and 74. Circular portion 84 has a diameter $D_{CP}$ which is larger than width $W_{EP}$ in this example. The circular portion is in fluid communication with and extends radially outwards from elongate portion 82. Pocket 70 is circular at least in part in front profile in this example.

First female connector 66 includes a peripheral portion, in this example a lip 86. The lip is annular in profile at least in part in this example. Lip 86 extends about circular portion 84 of bulb-shaped opening 80.

Figure 5:
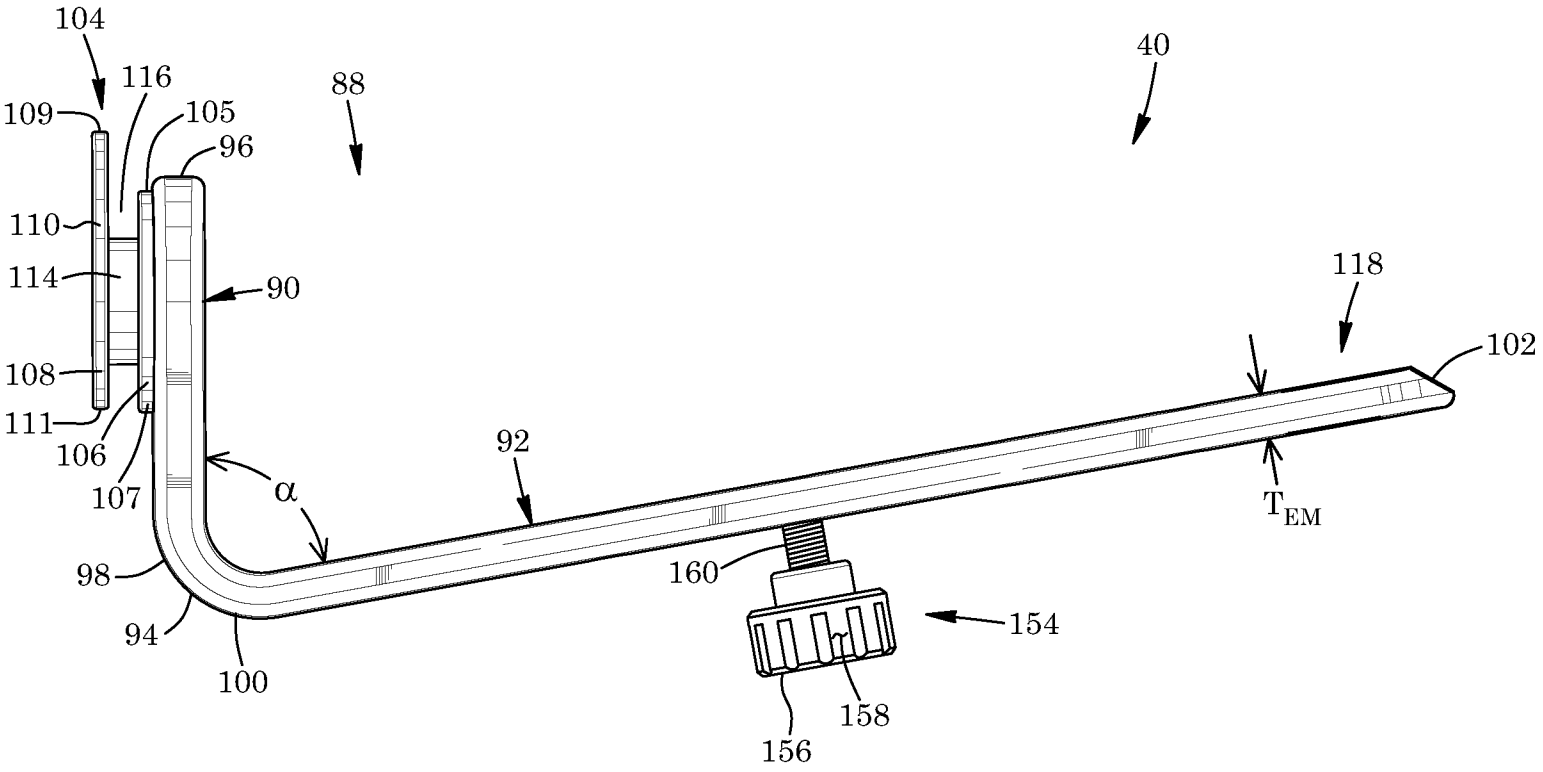
FIG. 5 is a right side perspective view of the elongate mount of the carrier device of FIG. 1, with the elongate mount including a first male connector coupled thereto.

As seen in FIG. 5, the carrier device 40 includes an elongate mount 88. The elongate mount is an L-shaped bracket in this example; however this is not strictly required and the elongate mount may have other shapes in other embodiments. Elongate mount 88 includes a first portion, in this example a first elongate member 90. The elongate mount includes a second portion, in this example a second elongate member 92 coupled to the first elongate member. The first elongate member is integrally formed with the second elongate member so as to form a unitary whole in this example. First elongate member 90 and second elongate member 92 are formed by a single elongate plate separated by bent portion 94 of the elongate mount 88 in this example; however, this is not strictly required. The elongate members are each generally rectangular and planar in this example. As seen in FIG. 5, first elongate member 90 extends outwards from and is angled relative to second elongate member 92 by angle $\alpha$. Angle $\alpha$ is equal to or less than 90 degrees in this example, in this case being an acute angle; however, this is not strictly required. Angle $\alpha$ is approximately 75 degrees in this example; however this is not strictly required and angle $\alpha$ may equal to other values in other embodiments.

Figure 6:
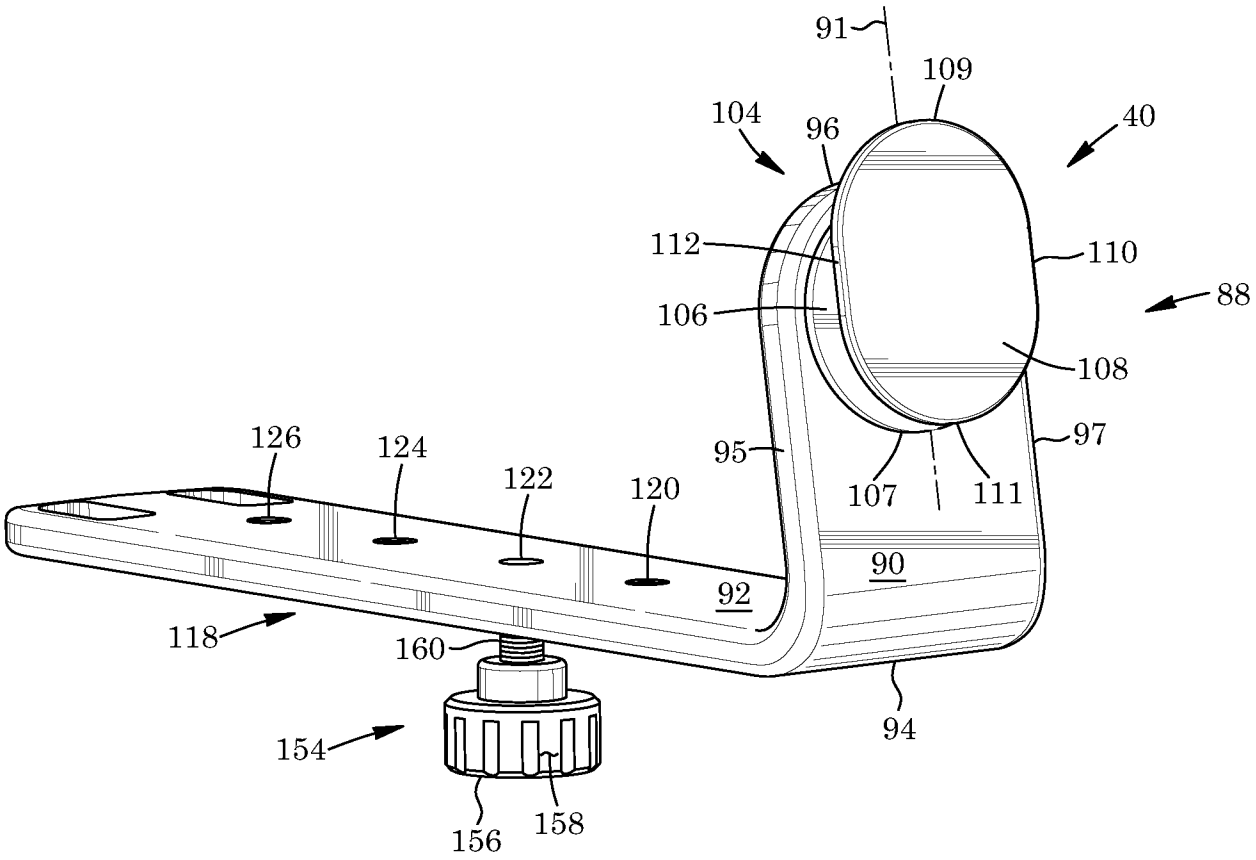
FIG. 6 is a rear, left side, top perspective view of the elongate mount of the carrier device of FIG. 5, with the elongate mount being shown in fragment.
Figure 7:
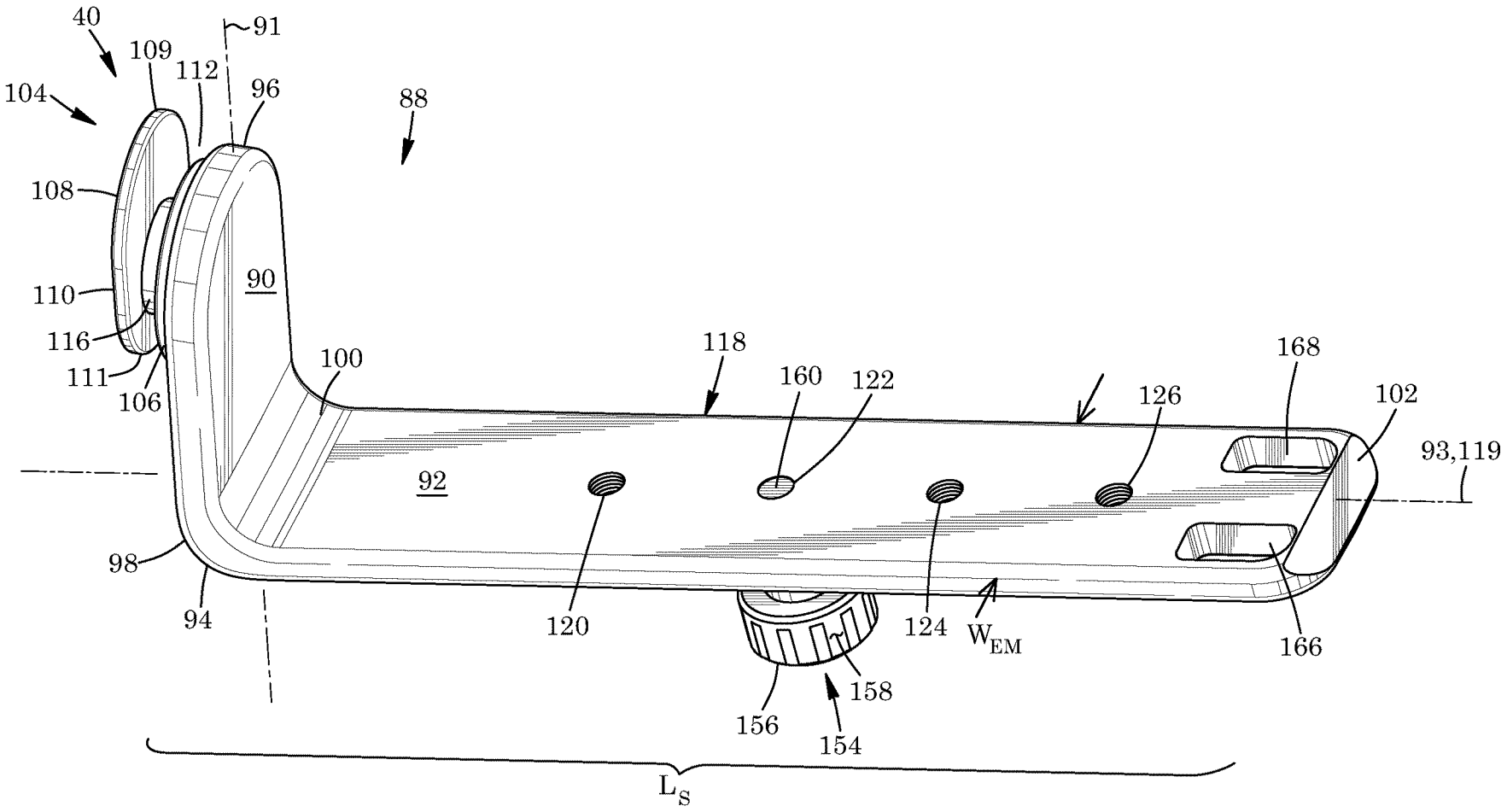
FIG. 7 is a right side, top, front perspective view of the elongate mount of the carrier device of FIG. 5.

As seen in FIG. 7, first elongate member 90 has a first or proximal end 96 that is round, outwardly convex and semi-circular in this example. The first elongate member has a second or distal end 98 adjacent to bent portion 94 of the elongate mount 88. First elongate member 90 extends along a longitudinal axis 91. The longitudinal axis of the first elongate member is vertical at least in part when carrier device 40 is in use and from the perspective of FIG. 7. As seen in FIG. 6, first elongate member 90 includes spaced-apart and opposed peripheral portions 95 and 97 that are elongate. The peripheral portions of the first elongate member are generally rectangular prisms in shape in this example. Peripheral portions 95 and 97 of first elongate member 90 extend from proximal end 96 of the first elongate member to distal end 98 of the first elongate member.

Second elongate member 92 has a first or proximal end 100 adjacent the bent portion of the elongate mount and a second or distal end 102 spaced-apart from the proximal end thereof. The distal end of the second elongate member is spaced-apart from first elongate member 90. Second elongate member 92 extends along a longitudinal axis 93. The longitudinal axis of the second elongate member is horizontal at least in part when carrier device 40 is in use and from the perspective of FIG. 7. Second elongate member 92 has a length Ls spanning from adjacent proximal end 100 thereof to adjacent distal end 102 thereof. Each elongate member a width $W_{EM}$ seen in FIG. 7 and a thickness $T_{EM}$ seen in FIG. 5.

Figure 16:
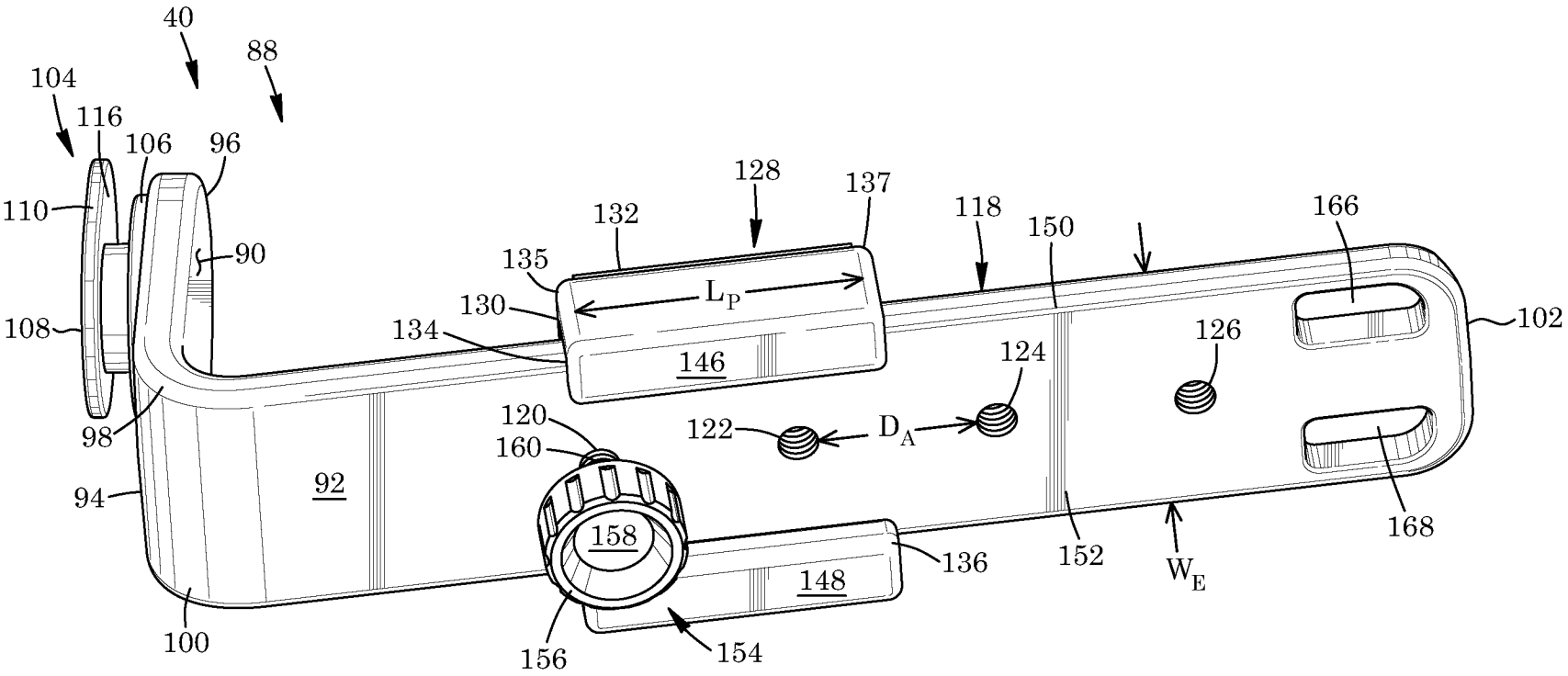
FIG. 16 is a bottom, right side, front perspective view of the elongate mount, second female connector and threaded member of the carrier device of FIG. 15, with the second female connector being positioned between the proximal end and a distal end of the second elongate member, and with the threaded member threadably coupling to the proximal said aperture and abutting the second female connector adjacent a proximal end of the second female connector.

Referring to FIG. 16, second elongate member 92 of elongate mount 88 includes spaced-apart and opposed peripheral portions 150 and 152 that are elongate. The peripheral portions of the second elongate member are generally rectangular prisms in shape in this example. Peripheral portions 150 and 152 of second elongate member 92 extend from proximal end 100 of the second elongate member to the distal end 102 of the second elongate member.

Referring to FIG. 6, elongate mount 88 includes a second of the first female connector and the first male connector coupled thereto, in this example first male connector 104. The first male connector is adjacent and couples to first elongate member 90 in this example. First male connector 104 is outwardly convex at least in part in shape. The first male connector is circular in outer profile at least in part in this example. First male connector 104 includes a first, inner or proximal plate 106. The proximal plate couples to first elongate member 90.

Proximal plate 106 of first male connector 104 has a top 105 and a bottom 107 spaced-apart from the top thereof. The top and bottom of the proximal plate of the first male connector are outwardly concave in this example, in this case semi-circular in profile. Top 105 of proximal plate 106 of first male connector 104 is adjacent to and inwardly spaced from proximal end 96 of first elongate member 90. The proximal plate of the first male connector extends therefrom towards distal end 98 of the first elongate member. Proximal plate 106 of first male connector 104 is integrally formed with the first elongate member of elongate mount 88 so as to form a unitary whole in this example. The proximal plate of the first male connector is circular in this example, though this is not strictly required. Proximal plate 106 of first male connector 104 is adjacent to and inwardly spaced from peripheral portions 95 and 97 of first elongate member 90 in this example.

Still referring to FIG. 6, first male connector 104 includes a second, outer or distal plate 108. The distal plate of the first male connector couples to and is spaced-apart from proximal plate 106 of the first male connector in this example. Distal plate 108 of first male connector 104 is elongate and obround in this example, though this is not strictly required. The distal plate of the first male connector has a top 109 and a bottom 111 spaced-apart from the top thereof. The top and bottom of distal plate 108 of first male connector 104 are outwardly concave in this example, in this case semi-circular in profile. As seen in FIG. 5, bottom 107 of proximal plate 106 of first male connector 104 generally aligns with bottom 111 of distal plate 108 of the first male connector in this example. The distal plate is longer in height and generally extends upwards relative to the proximal plate in this example, with top 109 of the distal plate of the first male connector being spaced-apart from and positioned upwards from top 105 of the proximal plate of the first male connector in this example and from the perspective of FIG. 5.

Referring back to FIG. 6, distal plate 108 of first male connector 104 has a pair of opposed planar or flat edges 110 and 112. The flat edges of the distal plate of the first male connector extend between top 109 and bottom 111 of the distal plate of the first male connector. Flat edges 110 and 112 of distal plate 108 of first male connector 104 extend parallel with each other and longitudinal axis 91 of first elongate member 90 in this example. Proximal plate 106 and distal plate 108 differ in a diameter at least in part, though this is not strictly required.

As seen in FIG. 5, first male connector 104 includes a body 114. The body of the first male connector is cylindrical in this example, though this is not strictly required. Body 114 couples together proximal plate 106 and distal plate 108 of first male connector 104. The body of the first male connector in this example is integrally formed with the proximal plate and distal plate so as to form a unitary whole; however this is not strictly required. Body 114 of first male connector 104 is radially inwardly spaced relative to the proximal plate 106 and distal plate 108 in this example. The body of the first male connector defines an annular recess 116 between proximal plate 106 and distal plate 108 of the first male connector in this example. The plates are thus spaced-apart by the body 114, which has a smaller diameter than the plates. Plates 106 and 108 and body 114 form a U-shape channel in side profile as seen in FIG. 5 in this example.

As seen in FIG. 5, elongate mount 88 includes a first of a second female connector and a second male connector, in this example second male connector 118. The second male connector comprises second elongate member 92 in this example. As seen in FIG. 7, second male connector 118 has a longitudinal axis 119, which corresponds to longitudinal axis 93 of second elongate member 92.

Figure 15:
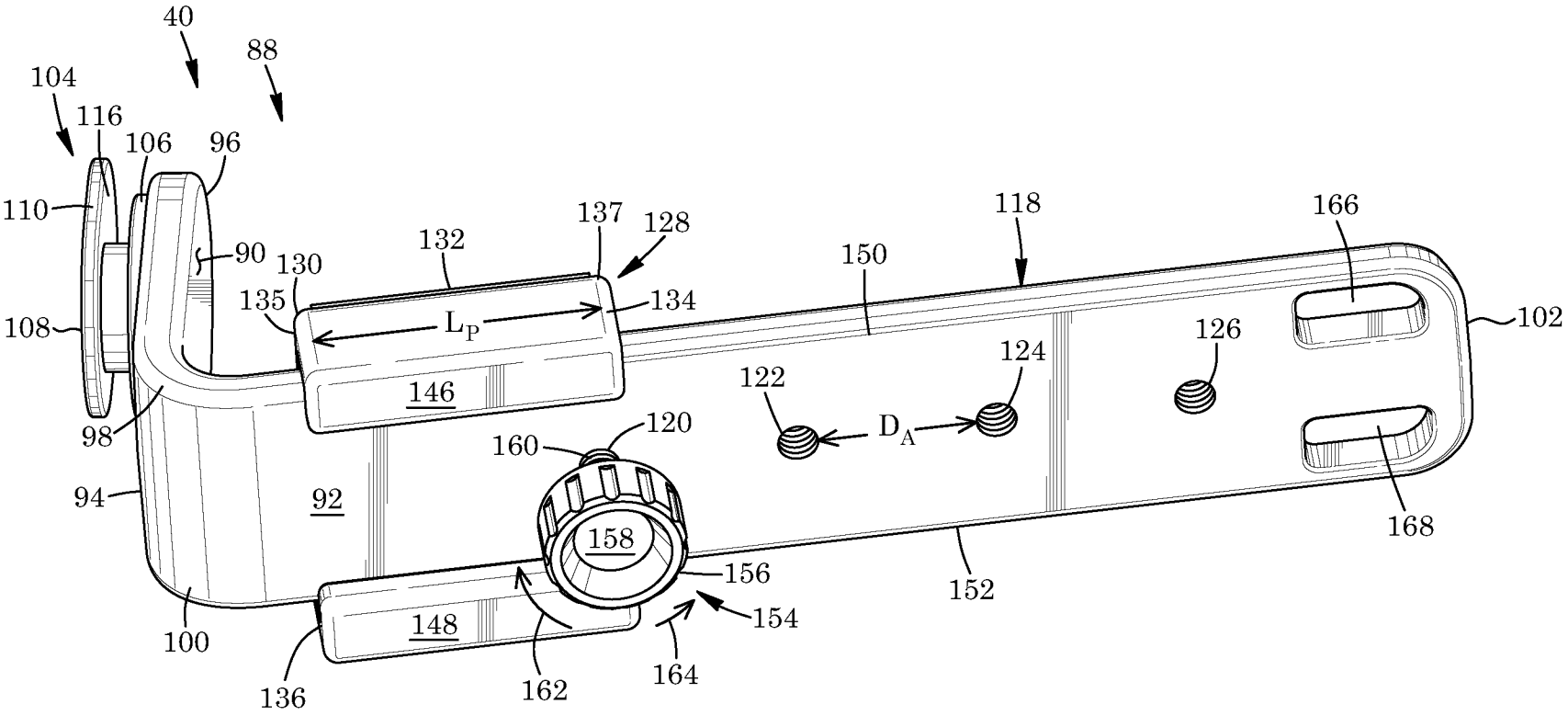
FIG. 15 is a bottom, right side, front perspective view of the elongate mount, second female connector and threaded member of the carrier device of FIG. 14, with the carrier device shown in a retracted position in which the second female connector is adjacent to a proximal end of a second elongate member, with the second elongate member of the elongate mount having a plurality of longitudinally-extending apertures extending therethrough, and with the threaded member threadably coupling to a proximal said aperture and abutting the second female connector adjacent a distal end of the second female connector.

The second male connector has a plurality of longitudinally spaced-apart apertures 120, 122, 124 and 126 extending through the second elongate member of elongate mount 88. Aperture 122 is approximately halfway between proximal end 100 and distal end 102 of second elongate member 92 in this example. Aperture 120 is closer to the proximal end than the distal end of the second elongate member. Aperture 124 is closer to distal end 102 than proximal end 100 of second elongate member 92. Aperture 126 is closer to the distal end of the second elongate member compared to the positioning of aperture 124 relative to the distal end of the second elongate member. Referring to FIG. 15, apertures 120, 122, 124 and 126 are evenly spaced-apart in this example, with adjacent pairs of apertures 122 and 124 are separated by a distance $D_A$.

Figure 8:
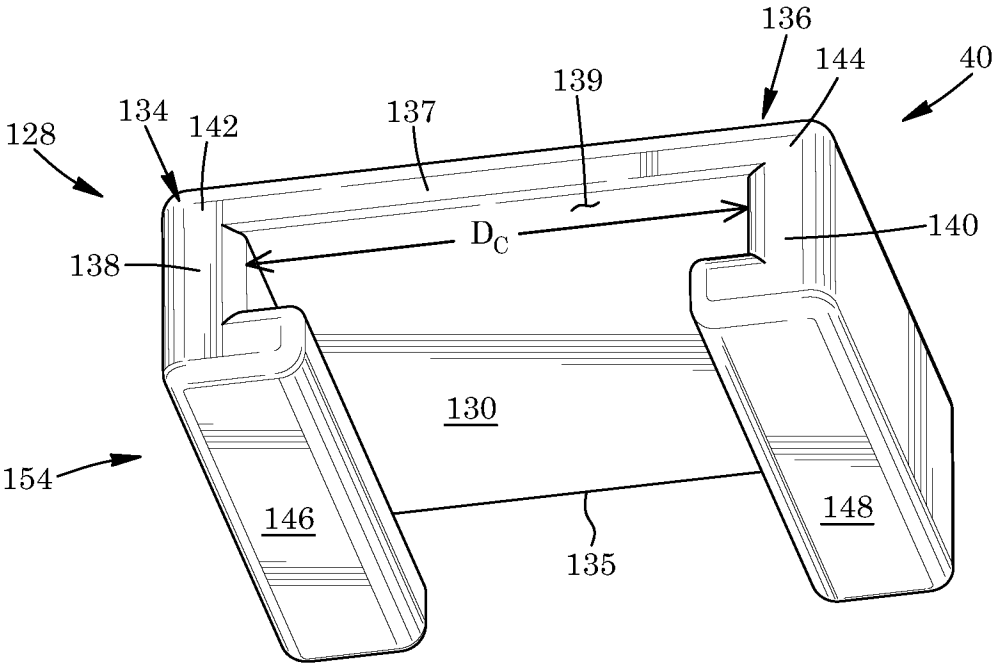
FIG. 8 is a front, bottom, right side perspective view of a second female connector of the carrier device of FIG. 1.
Figure 10:
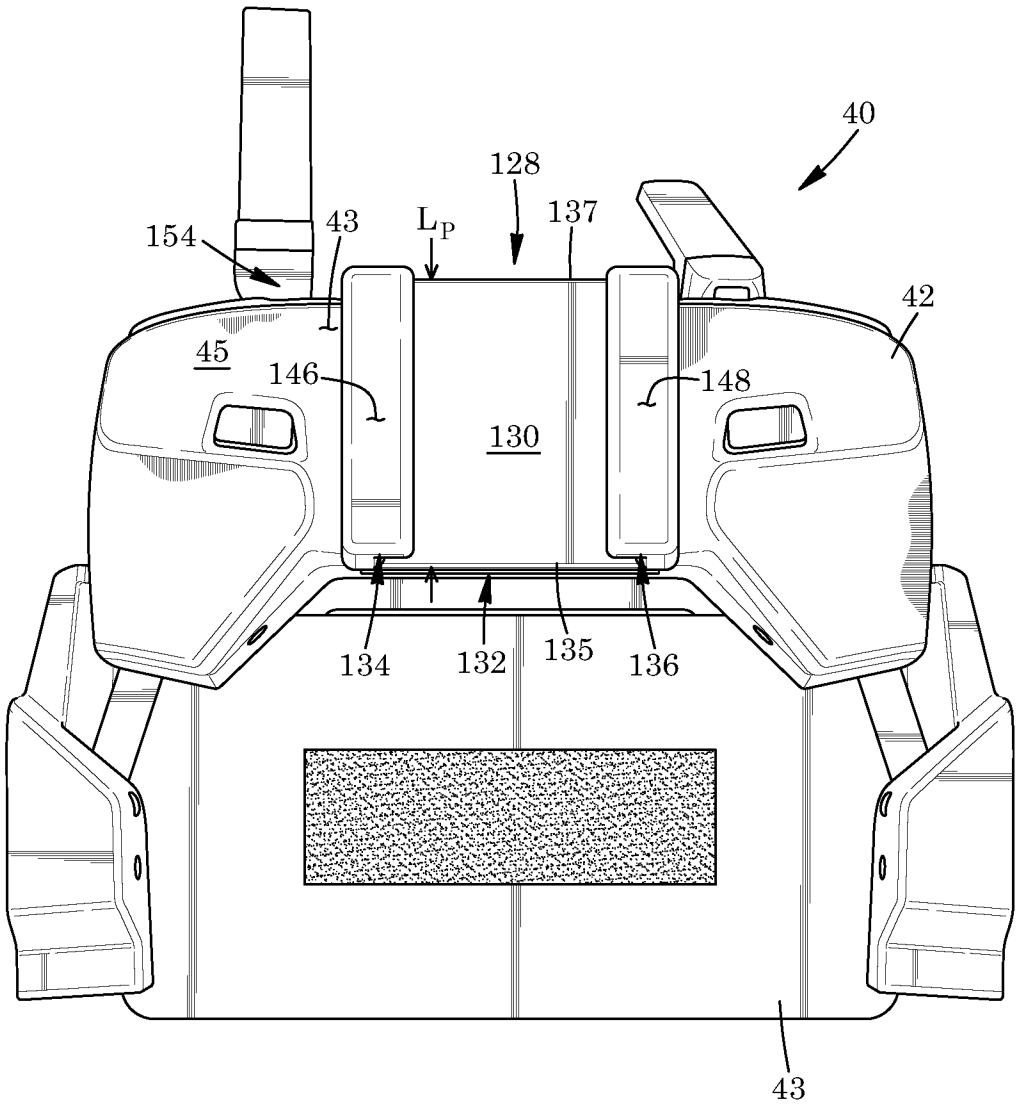
FIG. 10 is a bottom plan view of the drone controller of FIG. 1, together with the second female connector of the carrier device of FIG. 9 shown coupled to a bottom thereof.

Referring now to FIG. 8, carrier device 40 includes a second of the second female connector and the second male connector, in this example second female connector 128. The second female connector may be referred to as a female member. Second female connector 128 includes a planar member, in this example a plate 130. The plate may be referred to as a first wall and is rectangular in this example; however this is not strictly required. Plate 130 of second female connector 128 has a first or proximal end 135 and a second or distal end 137 spaced-apart from the proximal end thereof. Referring to FIG. 10, the plate of the second female connector has a length $L_P$ extending between the proximal end thereof and the distal end thereof. Proximal end 135 and distal end 137 of plate 130 of second female connector 128 may be referred to as the proximal end and the distal end of the second female connector 128. As seen in FIG. 8, the plate of the second female connector has a pair of peripheral portions 142 and 144 extending between proximal end 135 thereof and distal end 137 thereof.

Figure 9:
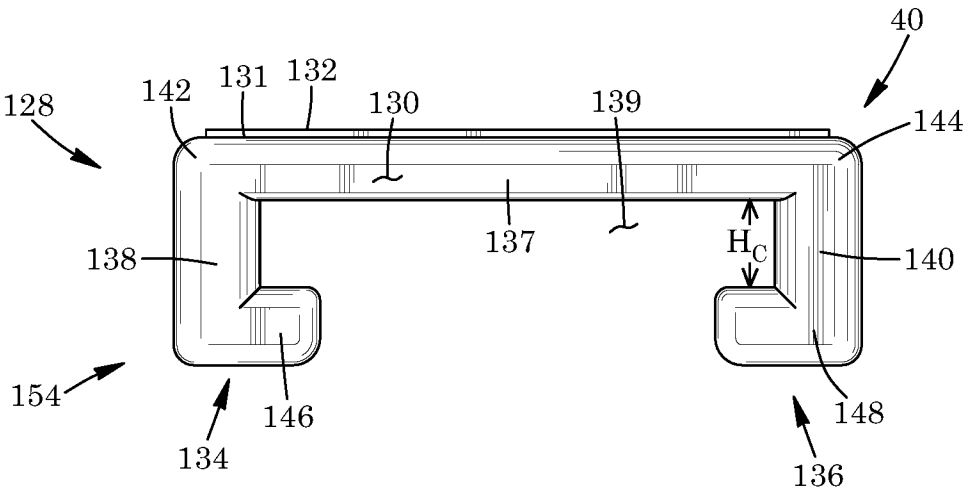
FIG. 9 is a front elevation view of the second female connector of the carrier device of FIG. 1.

As seen in FIG. 10, second female connector 128 is connectable to drone controller 42. In this example, outer surface 131 of plate 130 of the second female connector seen in FIG. 9, is connectable to a bottom portion 43 of outer housing 45 of the drone controller seen in FIG. 10. The plate of the second female connector couples to drone controller 42 via adhesive, in this case double-sided adhesive tape 132 seen in FIG. 9. The tape is an off-the-shelf product, in this example VHB™ brand tape which may be purchased at 3M Company having an address at 3M Corporate Headquarters 3M Center St. Paul, MN, 55144-1000, USA. However, this is not strictly required and other types of double-sided adhesive may be used in other embodiments.

As seen in FIG. 9, second female connector 128 includes at least one, and in this example a pair of opposed channels 134 and 136. The channels of the second female connector couple to plate 130 of the second female connector in this example. Channels 134 and 136 of second female connector 128 are integrally formed with the plate of the second female connector so as to form a unitary whole in this example. Channel 134 is C-shaped in lateral section and channel 136 is reverse C-shaped in lateral section in this example.

The channels of second female connector 128 have a pair of side walls 138 and 140. The side walls of channels 134 and 136 couple to peripheral portions 142 and 144 of plate 130, respectively. Side walls 138 and 140 of the channels are integrally formed with peripheral portions of the plate so as to form a unitary whole in this example. The side walls of channels 134 and 136 extend perpendicular to and downwards from plate 130 in this example and from the perspective of FIG. 9.

The channels of second female connector 128 include a pair of inwardly-extending bottom walls or flanges 146 and 148. The flanges of channels 134 and 136 extend parallel to plate 130 in this example and may be referred to as second walls. Flanges 146 and 148 of the channels couple to the plate via side walls 138 and 140, respectively. The flanges of channels 134 and 136 extend perpendicular to and inwards from the side walls of the channels in this example. Flanges 146 and 148 of the channels are integrally connected to side walls 138 and 140 of the channels so as to form a unitary whole in this example. The side walls and flanges of channels 134 and 136 are rectangular prisms in shape in this example; however, this is not strictly required.

As seen in FIG. 8, side walls 138 and 140 of channels 134 and 136 are separated by an opening or space 139 spanning a distance $D_C$. Width $W_{EM}$ of second elongate member 92 of elongate mount 88 seen in FIG. 7 is equal to or less than the distance of separation between the walls of the channels in this example. As seen in FIG. 9, each channel 136 has a height $H_C$ extending spanning space 139 between plate 130 and its respective flange 148 thereof. Thickness $T_E$ of second elongate member 92 of elongate mount 88 seen in FIG. 5 is equal to or less than that height $H_C$ of each of the channels seen in FIG. 9 in this example. Second female connector 128 seen in FIG. 8 is thus shaped to snugly and slidably receive second male connector 118 including second elongate member 92 seen in FIG. 7, with positioning thereof relative to the second female connector being selectively adjustable thereby.

Figure 11:
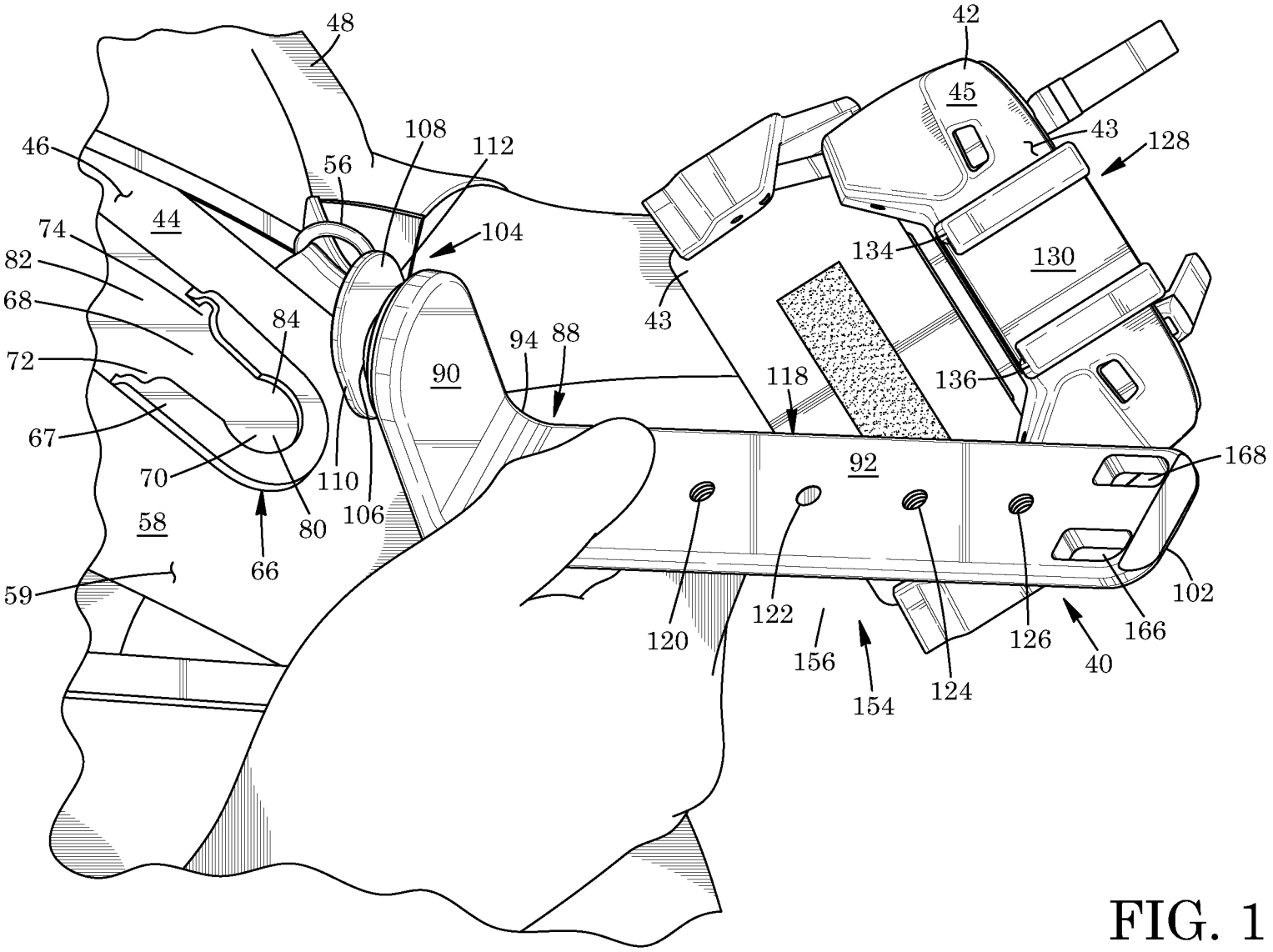
FIG. 11 is a top, right side, front perspective view of the carrier device and person shown in fragment of FIG. 1, with the first male connector of the elongate mount shown in the process of coupling to the first female connector of the torso plate, and with the drone controller also being shown with the second female connector of the carrier device coupled thereto.

In operation and referring to FIG. 11, first male connector 104 is only received by first female connector 66 in a particular circumstance. In particular, flat edges 110 and 112 of distal plate 108 of first male connector 104 must be aligned with elongate portion 82 of bulb-shaped opening 80 in u-shaped protrusion 67 of the first female connector i.e. with channels 72 and 74. Otherwise the cross-extent of distal plate 108 of first male connector 104 will be too wide to pass through elongate portion 82 of the bulb-shaped opening in the u-shaped protrusion of the first female connector. Distal plate 108 of first male connector 104 so positioned is slidably received by u-shaped slot 68 of first female connector 66 through opening 80 between channels 72 and 74.

The pair of opposed flat edges 110 and 112 of the distal plate of the first male connector are shaped to fit within and abut opposed channels 72 and 74 as seen in FIG. 12. The flat edges of distal plate 108 of first male connector 104 so aligned, received within and held in place by the channels, inhibit rotation of the first male connector relative to first female connector 66. Still referring to FIG. 12, body 114 is shaped to rest on and abut lip 86 of pocket 70 of first female connector 66 seen in FIG. 3 when distal plate 108 of first male connector 104 is disposed within U-shaped slot 68 of first female connector 66. Annular recess 116 of first male connector 104 seen in FIG. 5 engages and receives lip 86 of the pocket of the first female connector seen in FIG. 3.

Figure 13:
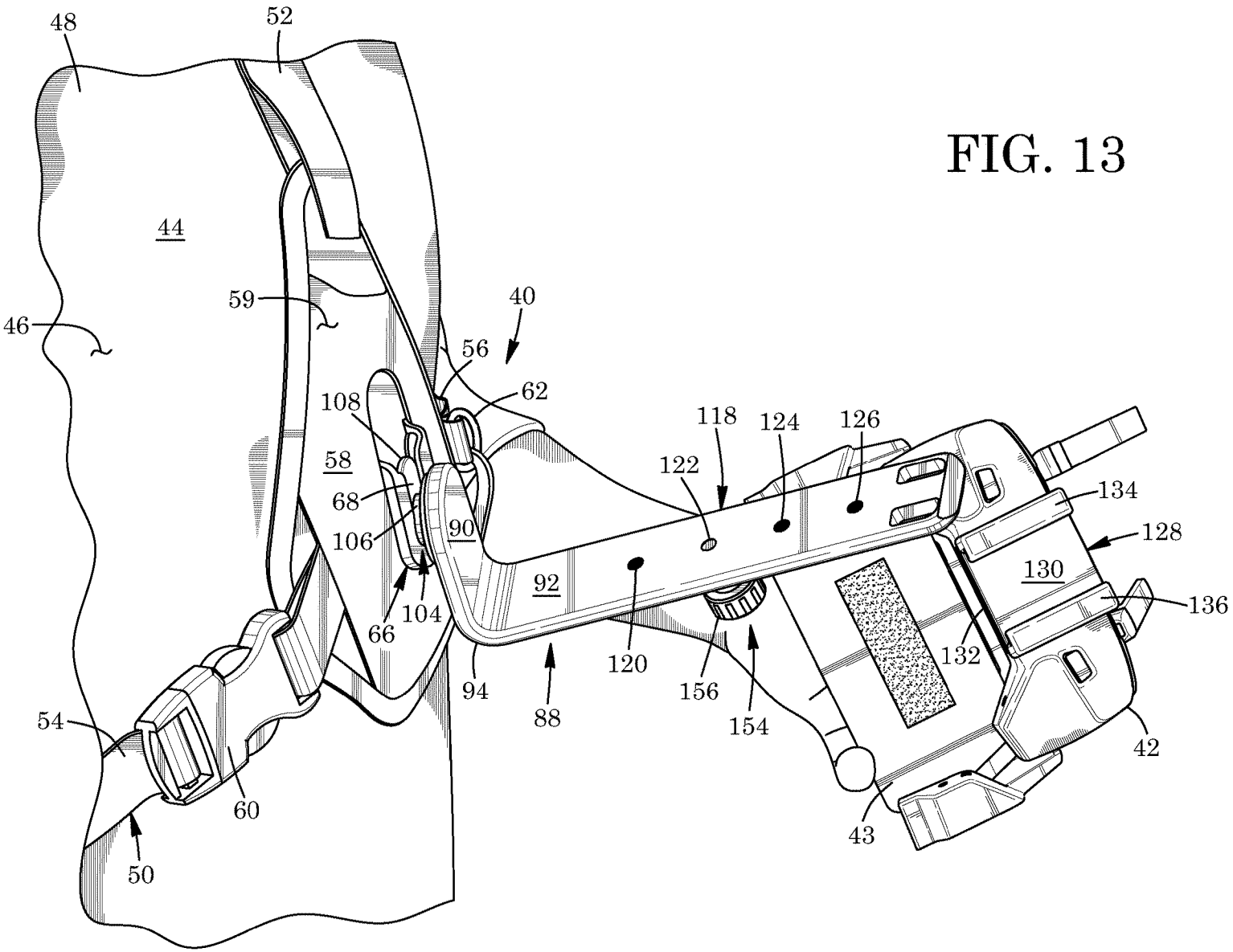
FIG. 13 is a top, right side, front perspective view of the carrier device and person shown in fragment of FIG. 11, with the elongate mount shown coupled to the torso plate via the first male connector and the first female connector, and with the drone controller shown in the process of coupling to a second elongate member of the elongate mount via the second female connector of the carrier device.

Referring to FIG. 13, elongate mount 88 thus selectively couples to torso plate 58 via first female connector 66 and first male connector 104. Plates 106 and 108 of the first male connector seen in FIG. 12 are on opposite sides of u-shaped slot 68 of the first female connector. Proximal plate 106 of first male connector 104 abuts exterior surfaces 71 of channels 72 and 74 of first female connector 66 when the first female connector receives and is coupled with the first male connector. Distal plate 108 of the first male connector extends at least in part within channels 72 and 74 of the first female connector and abuts interior surfaces 73 of the channels of the first female connector when the first female connector receives and is coupled with the first male connector. This prevents accidental decoupling of first male connector 104 and first female connector 66.

Figure 14:
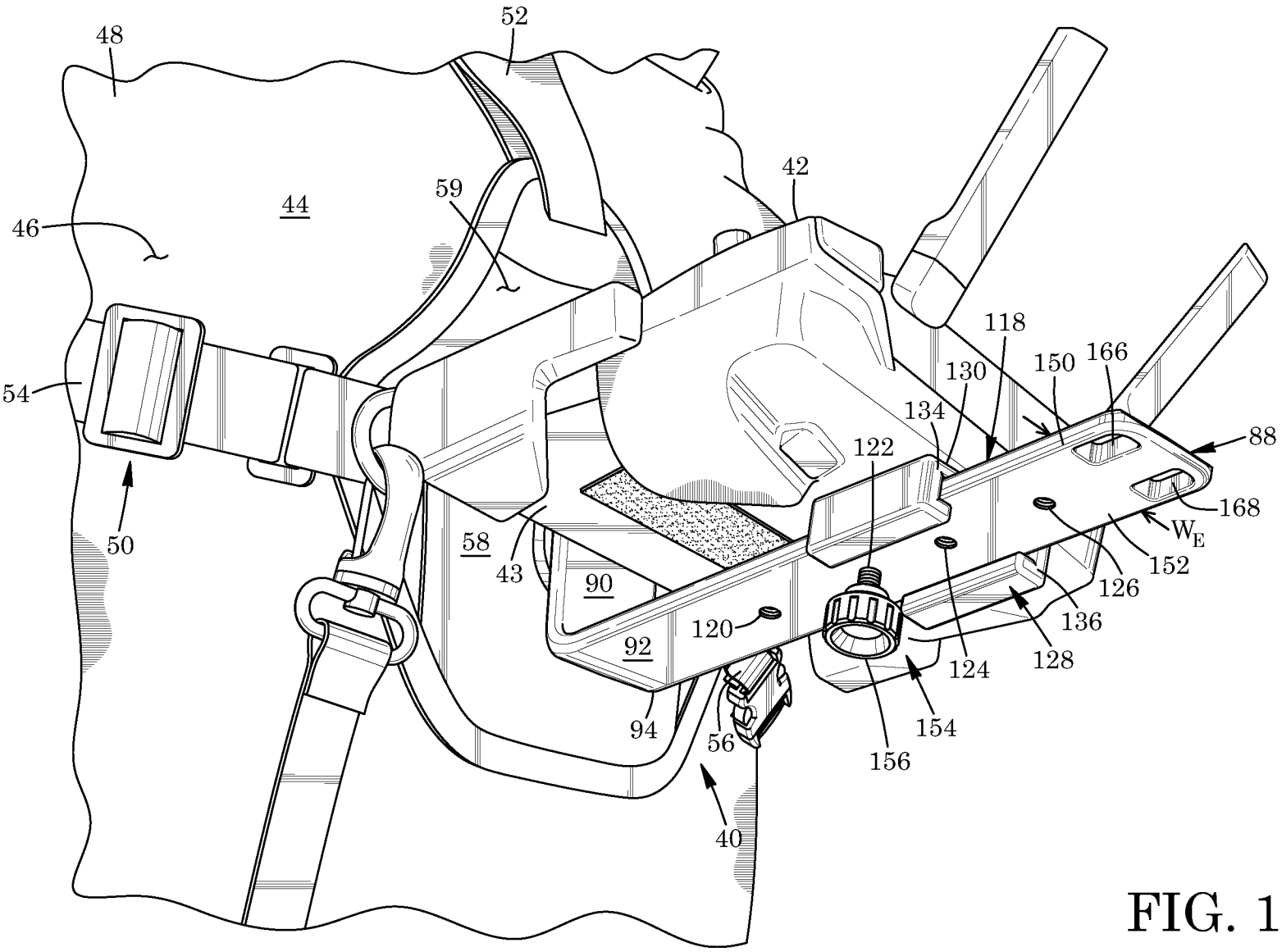
FIG. 14 is a bottom, right side, front perspective view of the carrier device and person shown in fragment of FIG. 13, with the elongate mount of the carrier device shown coupled to the torso plate of the carrier device, with the drone controller shown coupled via the second female connector to the elongate mount and thus to the torso plate of the carrier device, and with a threaded member of the carrier device also being shown extending through the elongate mount and abutting the second female connector.

Referring now to FIG. 14, opposed channels 134 and 136 of second female connector 128 are shaped to slidably receive and couple to second male connector 118, including second elongate member 92. The second elongate member of elongate mount 88 is shaped to be slidably received within the channels of the second female connector. Channels 134 and 136 are shaped to enclose opposed peripheral portions 150 and 152 of second elongate member 92 of elongate mount 88.

The elongate mount thus selectively couples to the drone controller 42 via second female connector 128 and second male connector 118. Referring to FIG. 1, this allows person 48 to carry the drone controller in a hands-free manner at chest-level. Drone controller 42 may be readily and easily removed from carrier device 40 because first male connector 104 is slidably received by first female connector 66, and second male connector 118 seen in FIG. 14 is slidably received by second female connector 128.

Referring to FIG. 15, carrier device 40 in this example includes an adjustment mechanism 154; however, this is not strictly required. The adjustment mechanism enables macro and micro adjustment of positioning of second female connector 128 relative to second male connector 118. The plurality of longitudinally spaced-apart apertures 120, 122, 124 and 126 of second elongate member 92 of elongate mount 88 are features of the adjustment mechanism.

Adjustment mechanism 154 includes a threaded member 156. The threaded member includes a gripping end portion 158 and a threaded end portion 160 coupled to and extending outwards from the gripping end portion thereof. Each of apertures 120, 122, 124 and 126 of second elongate member 92 of elongate mount 88 is shaped to selectively receive the threaded end portion of the threaded member. Threaded end portion 160 of threaded member 156 is selectively insertable within respective ones of the apertures by rotating gripped end portion 158 of the threaded member in a first direction of rotation, in this example a clockwise direction 162 from the perspective of FIG. 15. This functions to actuate threaded member 156, with the threaded member being fastened to second elongate member 92 of elongate mount 88 thereby. The threaded member so fastened causes threaded end portion 160 thereof to extend through the second elongate member of the elongate mount and abut plate 130 of second female connector 128 when the plate is aligned with a given said aperture 120 of the second elongate member. Threaded member 156 when actuated or fastened thus inhibits movement of second male connector 118 relative to second female connector 128.

In operation and referring to FIG. 15, the second female connector is aligned with respective ones of the apertures 120 of second elongate member 92 of the second male connector of elongate mount 88. Adjustment mechanism 154 and second female connector 128 have a retracted position seen in FIG. 15 in which the second female connector is near the first male connector 104 and proximal end 100 of second elongate member 92. Threaded end portion 160 of threaded member 156 aligns with distal end 137 of plate 130 of second female connector 128 in the retracted position seen in FIG. 15. The threaded member is thereafter fastened or rotated in direction 162 to cause threaded end portion 160 to abut plate 130 adjacent the distal end of the plate. This secures second female connector 128, and thus drone controller 42 seen in FIG. 1, in place and inhibits movement of the second female connector and drone controller relative to second male connector 118.

Referring back to FIG. 15, to adjust positioning of the second female connector relative to the second male connector once more, threaded member 156 is unfastened or rotated via gripping end portion 158 in a second of rotation direction opposite the first direction of rotation, in this example in counter-clockwise direction 164. This causes threaded end portion 160 of the threaded member to no longer abut and engage with plate 130 of second female connector 128. This thereby enables the second female connector, and drone controller 42 seen in FIG. 1, to slidably move and be adjusted relative to second elongate member 92 once more.

As seen with reference to FIGS. 15 and 16, the continuous nature of plate 130 of second female connector 128 along its length $L_P$ thereof, enables micro adjustment of the second female connector relative to the second male connector 118. The length of the second female connector is equal to or greater than the distance $D_A$ between adjacent said apertures in this example. This thereby enables micro adjustment of positioning of second female connector 128 relative to second male connector 118 including second elongate member 92 for a given position of threaded member 156. The second female connector is thus moveable from the retracted position seen in FIG. 15, in which threaded end portion 160 of threaded member 156 extends through proximal said aperture 120 and aligns with distal end 137 of plate 130, to an intermediate position seen in FIG. 16 in which the threaded end portion continues to extend through proximal said aperture 120 and aligns with proximal end 135 of the plate. Adjustment mechanism 154 so configured enables such micro-adjustment of second female connector 128 relative to second male connector 118 for each of the apertures 120, 122, 124 and 126 through which the threaded member selectively couples.

The adjustment mechanism further enables macro adjustment of the second female connector relative to the second male connector including second elongate member 92. In this case, second female connector 128 is moveable from the retracted position seen in FIG. 15 to an extended position seen in FIG. 17. The second female connector is spaced-apart from first male connector 104 and proximal end 100 of second elongate member 92 in the extended position seen in FIG. 17. Threaded end portion 160 of threaded member 156 extends through distal said aperture 126 of second elongate member 92 of second male connector 118 and aligns with proximal end 135 of plate 130 in the extended position of second female connector 128 and adjustment mechanism 154 in this example.

Distal end 137 of plate 130 of the second female connector aligns with and is adjacent distal end 102 of the second elongate member of elongate mount 88 when in the extended position thereof in this example. Threaded member 156 is thereafter actuated or fastened, thereby thus enabling macro adjustment of positioning of second female connector 128 relative to second male connector 118 including second elongate member 92. Still referring to FIG. 17, adjustment mechanism 154 thus enables positioning of the second female connector to be adjusted relative to the second male connector including the second elongate member anywhere along the length Ls of the second elongate member spanning from adjacent proximal end 100 of the second elongate member to adjacent distal end 102 of the second elongate member.

Figure 17:
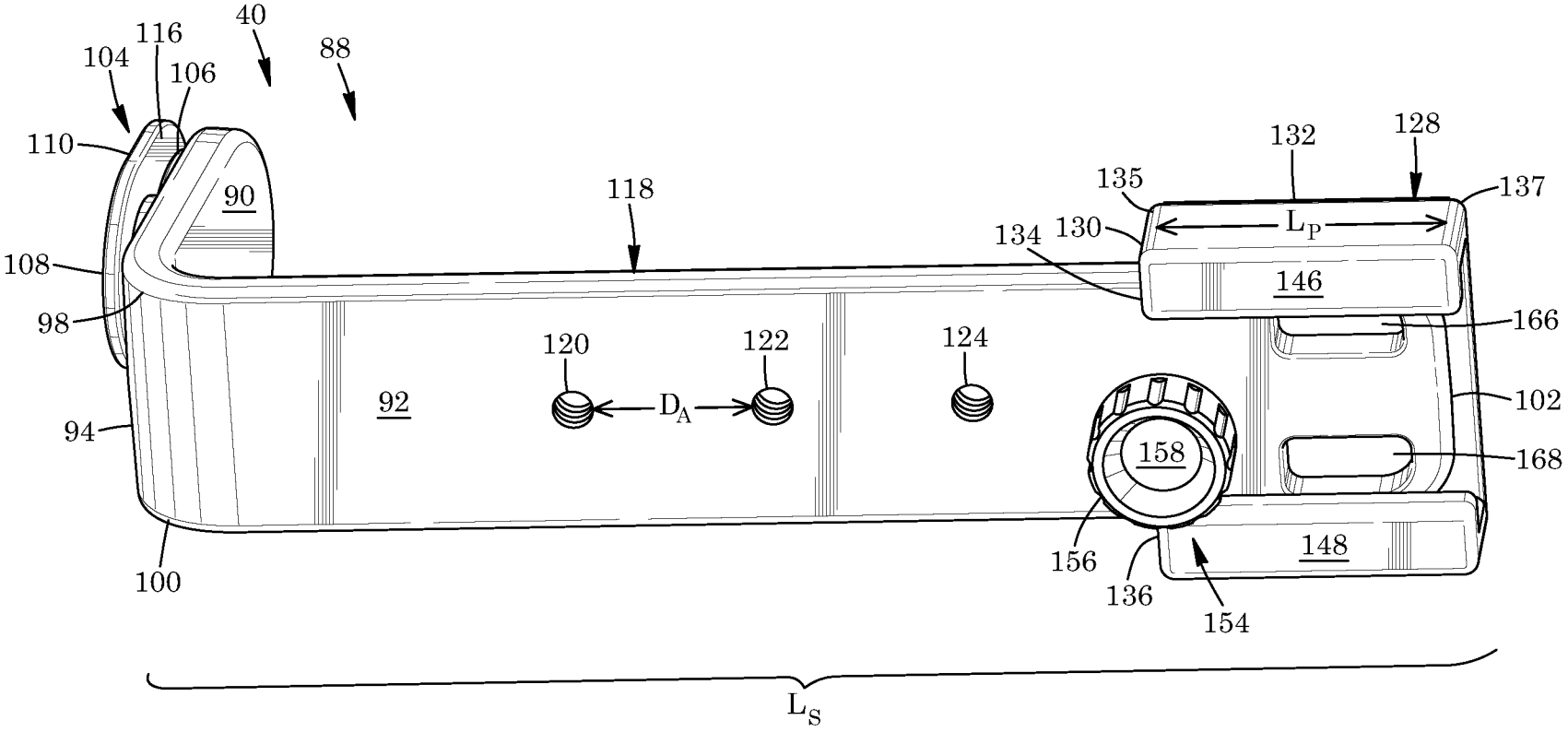
FIG. 17 is a bottom, right side, front perspective view of the elongate mount, second female connector and threaded member of the carrier device of FIG. 16, with the carrier device shown in an extended position in which the second female connector is adjacent to the distal end of the second elongate member and in which the threaded member threadably couples to a distal said aperture and abuts the second female connector adjacent to the proximal end of the second female connector.
Figure 19:
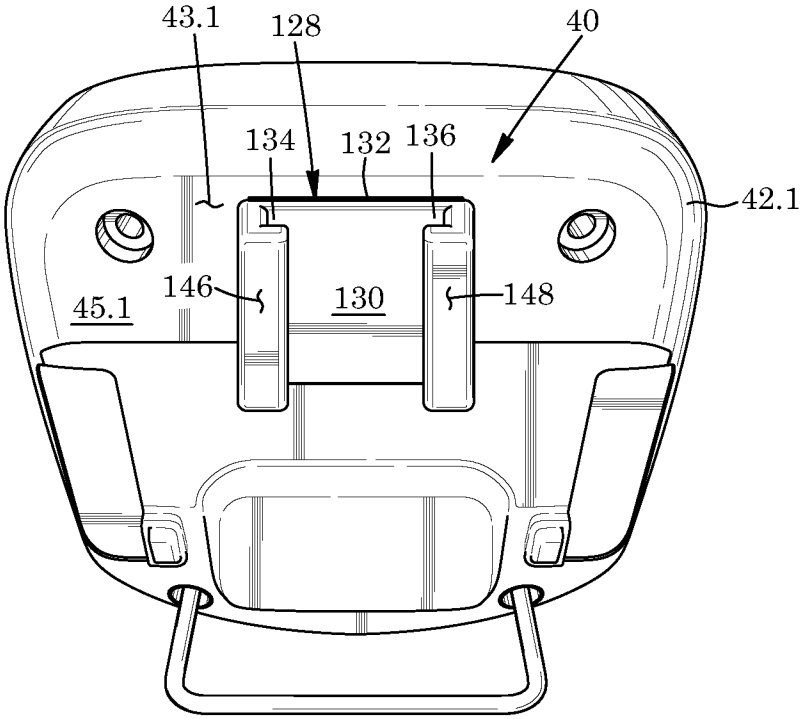
FIG. 19 is a bottom, front perspective view thereof.
Figure 18:
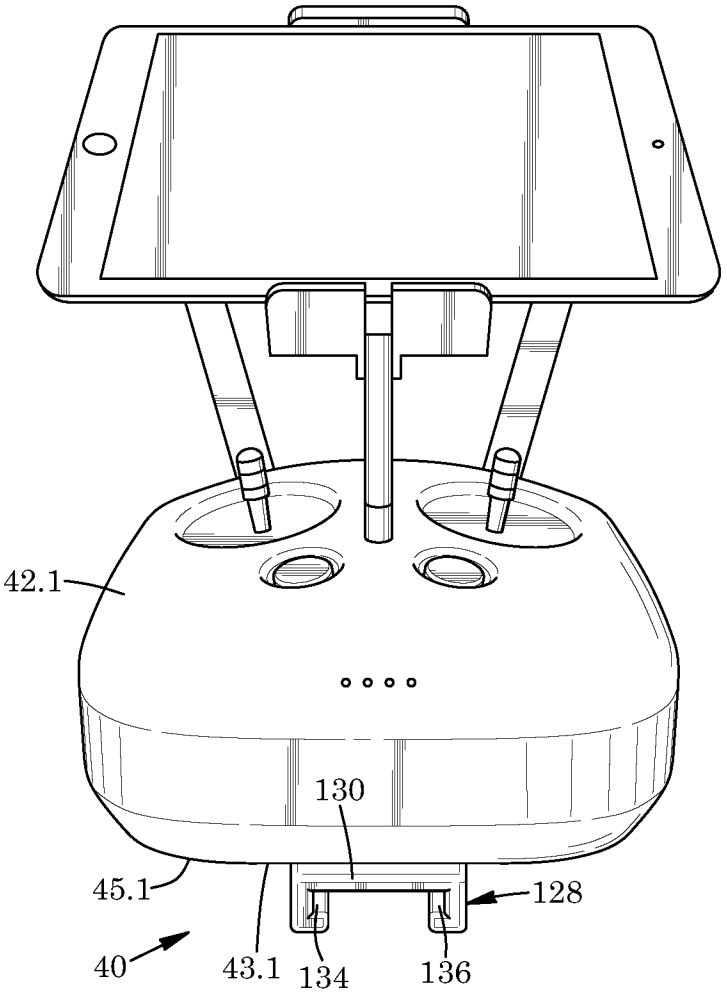
FIG. 18 is a front, top perspective view of the second female connector of the carrier device of FIG. 8 coupling to the bottom of a drone controller according to a second embodiment of the drone controller.

The adjustment mechanism of carrier device 40 seen in FIGS. 15 to 17, in addition to enabling micro and macro adjustment for a given drone controller, enables the carrier device to function with and couple to a wide variety of models of drone controllers, such as drone controller 42.1 seen in FIGS. 18 to 20. Like parts of drone controller 42.1 have like numbers and functions as the drone controller 42 shown in FIGS. 1 to 17 with the addition of decimal extension "0.1".

Alternatively, instead of adjustment mechanism 154 comprising threaded member 156 and apertures 120, 122, 124 and 126 seen in FIG. 17, second male connector 118 may be shaped to snugly fit within second female connector 128, with positioning of the second male connector relative to the second female connector being held in place at least in part via friction.

As seen in FIG. 16, elongate mount 88 has at least one and in this example pair of additional apertures, in this example tether apertures 166 and 168. Each of the tether apertures is rectangular in bottom/top profile in this example, though this is not strictly required. Tether apertures 166 and 168 extend through second elongate member 92. The tether apertures are positioned adjacent to distal end 102 of the second elongate member in this example. Tether aperture 166 aligns adjacent peripheral portion 150 of second elongate member 92 of elongate mount 88 and tether aperture 168 aligns adjacent peripheral portion 152 of the second elongate member of the elongate mount.

As seen in FIG. 2, carrier device 40 includes an elongate flexible member, in this example a safety tether 170. The safety tether has a first end 172 and a second end 174 spaced-apart from the first end thereof. The first end of safety tether 170 is selectively connectable to at least one of tether apertures 166 of elongate mount 88 seen in FIG. 16, in this example via a connector, in this case a snap hook 176 seen in FIG. 2. Still referring to FIG. 2, second end 174 of safety tether 170 is selectively connectable to strap assembly 50, in this example peripheral strap 178 in this case via a connector, in this instance quick release buckle 180. The safety tether thus selectively couples to torso plate 58 and jacket 59. Safety tether 170 is configured to further inhibit elongate mount 88, and thus drone controller 42 seen in FIG. 1 coupled to the elongate mount 88, from falling to the ground 175 should second female connector 128 seen in FIG. 17 inadvertently dislodge from second male connector 118.

Figure 21:
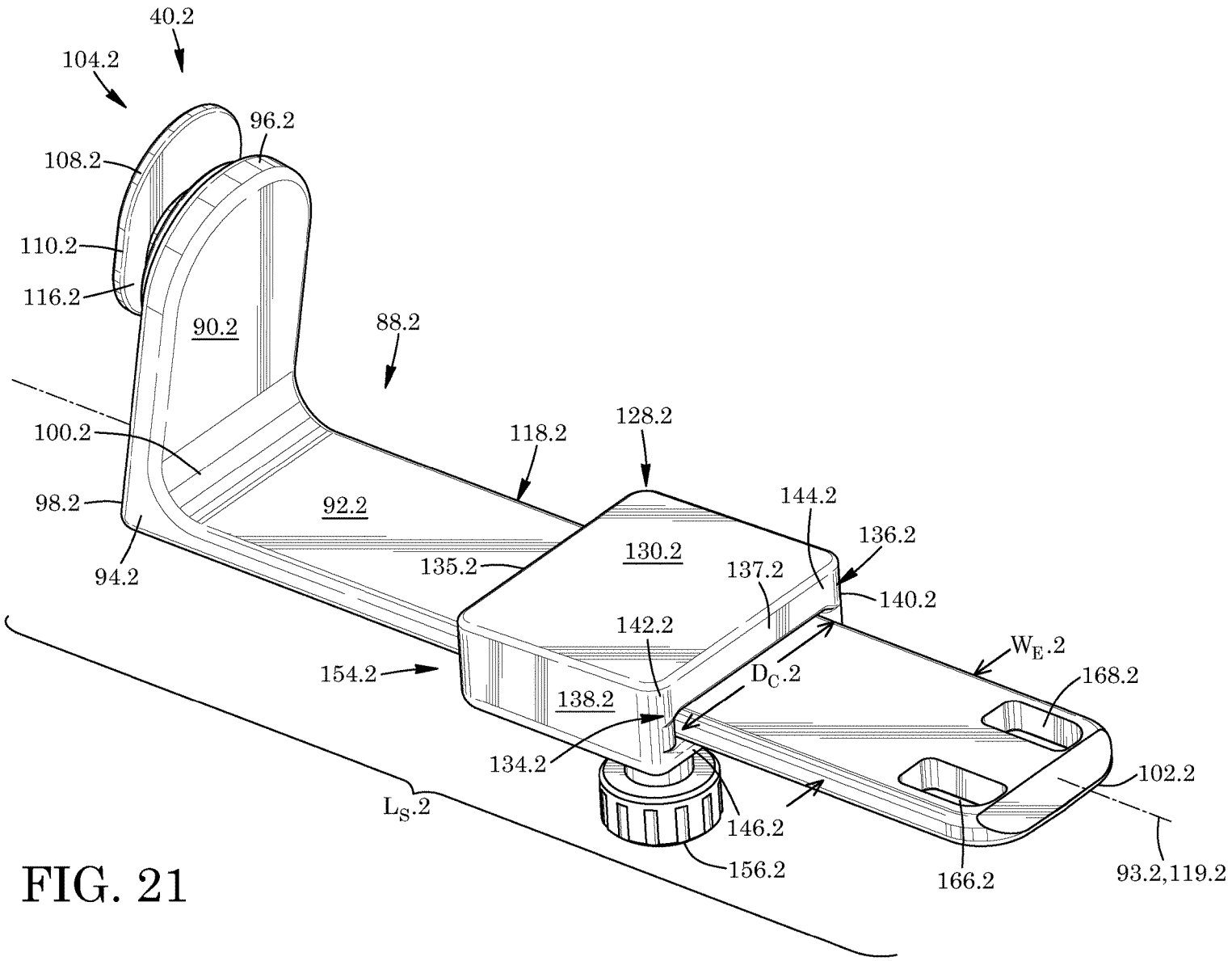
FIG. 21 a right side, top, front perspective view of an elongate mount, second female connector and threaded member according to another embodiment for the carrier device of FIG. 1.
Figure 22:
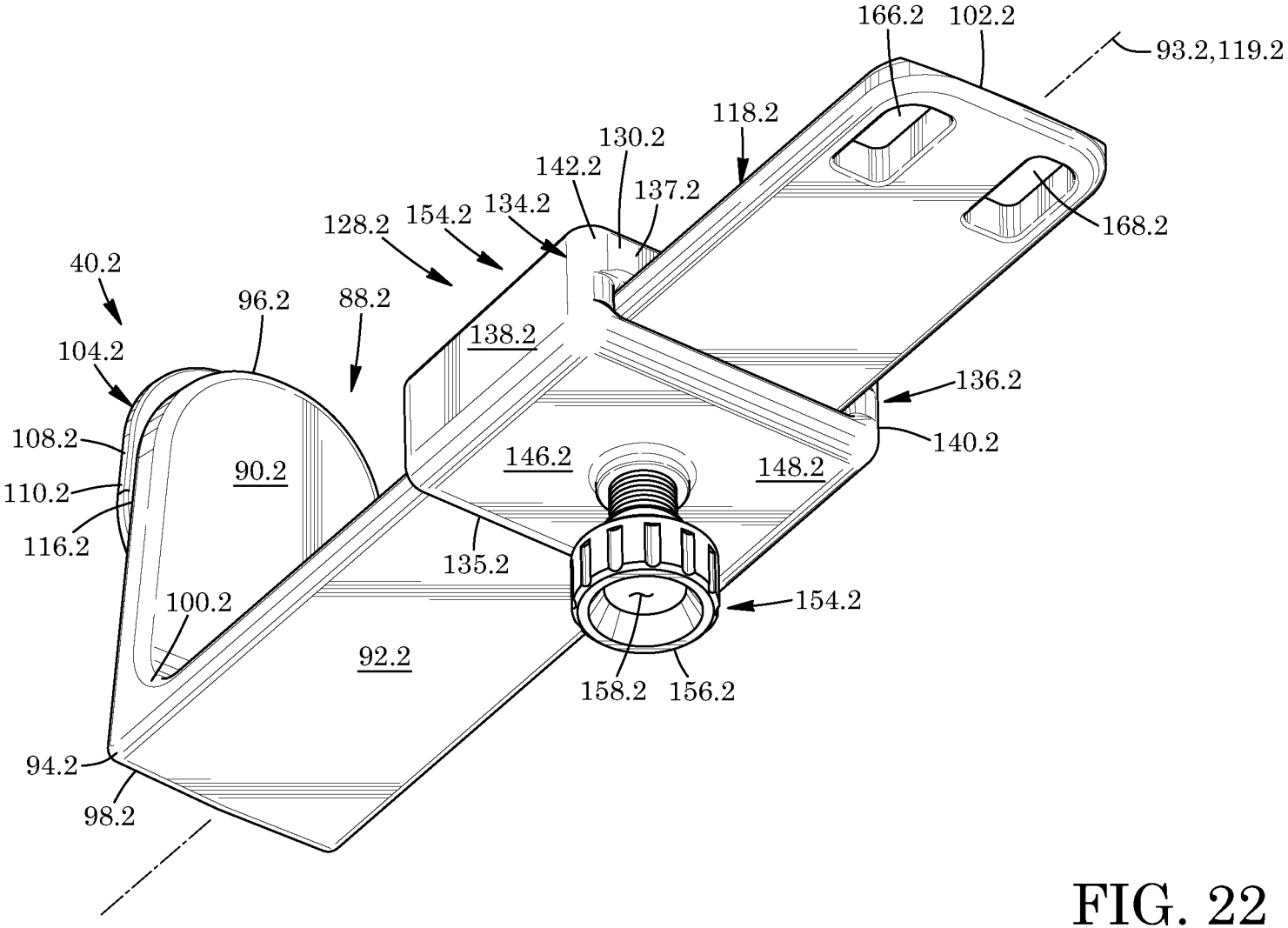
FIG. 22 is a right side, bottom, front perspective view thereof.

FIGS. 21 to 22 show an elongate mount 88.2, second female connector 128.2 and threaded member 156.2 according to another embodiment for the carrier device of FIG. 1. Like parts have like numbers and functions as elongate mount 88, second female connector 128 and threaded member 156 in FIGS. 1 to 20 with the addition of decimal extension "0.2". Elongate mount 88.2, second female connector 128.2 and threaded member 156.2 are substantially the same as elongate mount 88, second female connector 128 and threaded member 156 shown in FIGS. 1 to 20 with the following exceptions.

Flanges 146.2 and 148.2 are integrally coupled together so as to form a unity whole or plate. Second female connector 128.2 is thus a rectangular tube in shape.

Elongate mount 88 is continuous and does not include longitudinally spaced-apart apertures in this embodiment. Rather, threaded member 156.2 selectively couples to second elongate member 92.2 via a friction or interference fit in this example anywhere within the range spanning ends 100.2 and 102.2 of the second elongate member.

Where a component (e.g. an assembly, device etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Interpretation of Terms

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, between two or more elements; the coupling or connection between the elements can be physical, logical, or a combination thereof;
- "herein", "above", "below", and words of similar import, when used to describe this specification, shall refer to this specification as a whole, and not to any particular portions of this specification;
- "or", in reference to a list of two or more items, covers all of the following interpretations of the word: any of the items in the list, all of the items in the list, and any combination of the items in the list;
- the singular forms "a", "an", and "the" also include the meaning of any appropriate plural forms. These terms ("a", "an", and "the") mean one or more unless stated otherwise;
- "and/or" is used to indicate one or both stated cases may occur, for example A and/or B includes both (A and B) and (A or B);
- "approximately" when applied to a numerical value means the numerical value ±10%;
- where a feature is described as being "optional" or "optionally" present or described as being present "in some embodiments" it is intended that the present disclosure encompasses embodiments where that feature is present and other embodiments where that feature is not necessarily present and other embodiments where that feature is excluded. Further, where any combination of features is described in this application this statement is intended to serve as antecedent basis for the use of exclusive terminology such as "solely," "only" and the like in relation to the combination of features as well as the use of "negative" limitation(s)" to exclude the presence of other features; and
- "first" and "second" are used for descriptive purposes and cannot be understood as indicating or implying relative importance or indicating the number of indicated technical features.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present), depend on the specific orientation of the apparatus described and illustrated. The subject matter described herein may assume various alternative orientations. Accordingly, these directional terms are not strictly defined and should not be interpreted narrowly.

Where a range for a value is stated, the stated range includes all sub-ranges of the range. It is intended that the statement of a range supports the value being at an endpoint of the range as well as at any intervening value to the tenth of the unit of the lower limit of the range, as well as any subrange or sets of sub ranges of the range unless the context clearly dictates otherwise or any portion(s) of the stated range is specifically excluded. Where the stated range includes one or both endpoints of the range, ranges excluding either or both of those included endpoints are also included in the invention.

Certain numerical values described herein are preceded by "about". In this context, "about" provides literal support for the exact numerical value that it precedes, the exact numerical value ±5%, as well as all other numerical values that are near to or approximately equal to that numerical value. Unless otherwise indicated a particular numerical value is included in "about" a specifically recited numerical value where the particular numerical value provides the substantial equivalent of the specifically recited numerical value in the context in which the specifically recited numerical value is presented. For example, a statement that something has the numerical value of "about 10" is to be interpreted as: the set of statements:

in some embodiments the numerical value is 10;

in some embodiments the numerical value is in the range of 9.5 to 10.5;

and if from the context the person of ordinary skill in the art would understand that values within a certain range are substantially equivalent to 10 because the values with the range would be understood to provide substantially the same result as the value 10 then "about 10" also includes:

in some embodiments the numerical value is in the range of C to D where C and D are respectively lower and upper endpoints of the range that encompasses all of those values that provide a substantial equivalent to the value 10

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

As will be apparent to those of skill in the art upon reading this disclosure, each of the individual embodiments described and illustrated herein has discrete components and features which may be readily separated from or combined with the features of any other described embodiment(s) without departing from the scope of the present invention.

Any aspects described above in reference to apparatus may also apply to methods and vice versa.

Any recited method can be carried out in the order of events recited or in any other order which is logically possible. For example, while processes or blocks are presented in a given order, alternative examples may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, simultaneously or at different times.

Various features are described herein as being present in "some embodiments". Such features are not mandatory and may not be present in all embodiments. Embodiments of the invention may include zero, any one or any combination of two or more of such features. All possible combinations of such features are contemplated by this disclosure even where such features are shown in different drawings and/or described in different sections or paragraphs. This is limited only to the extent that certain ones of such features are incompatible with other ones of such features in the sense that it would be impossible for a person of ordinary skill in the art to construct a practical embodiment that combines such incompatible features. Consequently, the description that "some embodiments" possess feature A and "some embodiments" possess feature B should be interpreted as an express indication that the inventors also contemplate embodiments which combine features A and B (unless the description states otherwise or features A and B are fundamentally incompatible). This is the case even if features A and B are illustrated in different drawings and/or mentioned in different paragraphs, sections or sentences.

ADDITIONAL DESCRIPTION

Examples of carrier devices have been described. The following clauses are offered as further description.

(1) A carrier device for mounting an input device on a torso of a person, the carrier device comprising: a plurality of straps; a jacket connected to the plurality of straps so as to position the jacket substantially in a front middle portion of the torso of the person; a first of a first female connector and a first male connector coupled to the jacket; an elongate mount with a second of the first female connector and the first male connector coupled thereto, the elongate mount selectively coupling to the jacket via the first female connector and the first male connector, the elongate mount further including a first of a second female connector and a second male connector; and a second of the second female connector and the second male connector being connectable to the input device, the elongate mount selectively coupling to the input device via the second female connector and the second male connector.

(2) A carrier device according to clause 1, or any preceding or subsequent clause, wherein the first female connector has a U-shaped slot defined by a curved pocket and a pair of opposed channels which extend from the pocket, and wherein the first male connector has a plate slidably received by the U-shaped slot of the female connector.

(3) A carrier device according to any preceding or subsequent clause, wherein the plate of the first male connector is obround.

(4) A carrier device according to any one of clauses 2 to 3, or any preceding or subsequent clause, wherein the plate of the first male connector has a pair of opposed flat edges which are shaped to fit within and abut the opposed channels, and inhibit rotation of the first male connector relative to the first female connector.

(5) A carrier device according to clause 1, or any preceding or subsequent clause, wherein the first male connector comprises a first plate integrally formed with and coupled to the elongate mount, a second plate spaced-apart from the first plate, and a body which is integrally formed with and couples together the first plate and the second plate of the first male connector.

(6) A carrier device according to clause 5, or any preceding or subsequent clause, wherein the first plate of the first male connector is circular, wherein the body of the first male connector is cylindrical and wherein the second plate of the first male connector is obround.

(7) A carrier device according to any preceding or subsequent clause, wherein the elongate mount is an L-shaped bracket.

(8) A carrier device according to any preceding or subsequent clause, wherein the second male connector comprises an elongate plate and wherein the second female connector comprises a channel shaped to slidably receive and couple to the second male connector.

(9) A carrier device according to clause 8 or any preceding or subsequent clause, wherein the channel is C-shaped in lateral section.

(10) A carrier device according to any preceding or subsequent clause, including a threaded member which further selectively couples together the second male member and the second female connector and inhibits movement of the second male connector relative to the second female connector.

(11) A carrier device according to clause 10 or any preceding or subsequent clause, wherein the second male connector includes a plurality of longitudinally spaced-apart apertures extending therethrough with each of which being shaped to selectively receive the threaded member, whereby the second female connector is slidable relative to the second male connector so as to align with respective ones of the apertures of the second male connector, with fastening of the threaded member thereafter causing the threaded member to engage with the second female connector and inhibit movement thereof thereafter.

(12) A carrier device according to any preceding or subsequent clause, wherein the carrier device includes a safety tether, wherein the elongate mount has at least one tether aperture to which a first end of the tether selectively couples, and wherein the tether selectively couples to the jacket via a second end thereof.

(13) A carrier device for mounting an input device on a torso of a person, the carrier device comprising: an elongate mount including a first of a female connector and a male connector at a first portion thereof; a torso plate positioned in place via a strap assembly, the torso plate including a second of the female connector and the male connector coupled thereto, with the elongate mount being selectively connectable to the torso plate via the connectors; and a female member connectable via adhesive to the input device, the female member slidably coupling with a second portion of the elongate mount.

(14) A carrier device according to clause 13, or any preceding or subsequent clause, wherein the female member includes a plate and a pair of opposed channels coupled to and integrally formed with the plate thereof.

(15) A carrier device according to any one of clauses 13 to 14, or any preceding or subsequent clause, wherein the second portion of the elongate mount has a width equal to or less than a distance of separation between the channels and wherein the second portion of the elongate mount has a thickness equal to or less than that the height of each said channel.

(16) A carrier device according to any one of clauses 13 to 15, or any preceding or subsequent clause, wherein the channels are shaped to enclose opposed peripheral portions of the elongate mount.

(17) A carrier device according to any one of clauses 13 to 16, or any preceding or subsequent clause, wherein the channels are C-shaped and reverse C shaped, respectively.

(18) A carrier device according to any one of clauses 13 to 17, or any preceding or subsequent clause, including a thread member actuation thereof selectively inhibits movement of the female member relative to the second portion of the elongate member

(19) A carrier device according to clause 18, or any preceding or subsequent clause, wherein the elongate mount has a plurality of longitudinally spaced-apart apertures extending through the second portion thereof

(20) A carrier device according to any one of clauses 13 to 19, or any preceding or subsequent clause, wherein positioning of the female member is adjustable from a retracted position in which the female member is near the first of the female connector and the male connector, to an extended position in which the female member is spaced-apart from the first of the female connector and the male connector.

(21) A carrier device according to clause 20, or any preceding or subsequent clause, wherein the second portion of the elongate mount has a distal end spaced-apart from the first portion of the elongate mount, and wherein the female member is near the distal end of the second portion of the elongate mount when in the extended position thereof.

(22) A carrier device for coupling an input device to a torso of a person, the carrier device comprising: a body plate to which positionable in place along the torso of the person via a strap assembly; a female connector including a plate connectable to the input device via adhesive and opposed channels coupled to and integrally formed with the plate thereof; and an elongate mount selectively connectable to the body plate and including an elongate member shaped to be slidably received within the channels of the female connector.

(23) A carrier device according to clause 22, or any preceding or subsequent clause, including a threaded member actuation thereof coupling together the female connector and the elongate member and inhibiting movement of the female connector relative to the elongate member.

(24) A carrier device according to clause 22, or any preceding or subsequent clause, including an adjustment mechanism enabling macro and micro adjustment of positioning of the female connector relative to the elongate member.

(25) A carrier device according to clause 24, or any preceding or subsequent clause, wherein the adjustment mechanism includes a threaded member and wherein the elongate member has a plurality of longitudinally spaced-apart apertures extending therethrough, whereby aligning the female connector with respective ones of the apertures and thereafter fastening the threaded member enables macro adjustment of positioning of the female connector relative to the elongate member, and whereby the female connector has a length equal to or greater than the distance between adjacent said apertures, thereby enabling micro adjustment of positioning of the female connector relative to the elongate member.

(26) A carrier device according to any one of clauses 24 to 25, or any preceding or subsequent clause, wherein the adjustment mechanism enables positioning of the female connector to be adjusted relative to the elongate member along continuous anywhere along a distance spanning from adjacent a first end of the elongate member to adjacent a second end of the elongate member.

(27) A carrier device for coupling an input device to a jacket of a person, the carrier device comprising: a female connector including a plate connectable to the input device via adhesive and opposed channels coupled to and integrally formed with the plate thereof; an elongate mount selectively connectable to the jacket via a first portion thereof and including an elongate member shaped to be slidably received within the channels of the female connector; and a threaded member actuation thereof further couples together the female connector and the elongate member and inhibits movement of the female connector relative to the elongate member.

(28) A carrier device according to any preceding or subsequent clause, wherein the input device is for remotely controlling an object.

(29) A carrier device according to any preceding or subsequent clause, wherein the input device is a drone controller.

(30) Apparatus including any new and inventive feature, combination of features, or sub-combination of features as described herein.

(31) Methods including any new and inventive steps, acts, combination of steps and/or acts or sub-combination of steps and/or acts as described herein.

It will be appreciated that many variations are possible within the scope of the invention described herein. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples, but should be given the broadest interpretation consistent with the description as a whole.

What is claimed is:

1. A carrier device for mounting an input device on a torso of a person, the carrier device comprising:

a plurality of straps;

a jacket connected to the plurality of straps so as to position the jacket in a front middle portion of the torso of the person;

an elongate mount including a first elongate member and a second elongate member;

first female and male connectors, one of which coupling to the jacket and the other of which coupling to the first elongate member of the elongate mount, with the elongate mount selectively coupling to the jacket via the first female and male connectors;

second female and male connectors, one of which coupling to or being part of the second elongate member of the elongate mount and the other of which being connectable to the input device, with the elongate mount selectively coupling to the input device via the second female and male connectors, wherein the second female member is C-shaped in lateral section so as to wrap around and be selectively removable from the second elongate member; and a threaded member which further selectively couples together the second male connector and the second female connector and inhibits movement of the second male connector relative to the second female connector, wherein the threaded member is positioned at the bottom of the second male connector, wherein the second male connector has a plurality of longitudinally spaced-apart apertures extending therethrough, with each said aperture being shaped to selectively receive the threaded member, whereby the second female connector is slidable relative to the second male connector so as to align with respective ones of the apertures of the second male connector, with fastening of the threaded member thereafter causing the threaded member to engage with the second female connector and inhibit movement thereof thereafter;

wherein the second elongate member of the elongate mount is shaped to support thereon and couple to and extend along a back of the input device.

2. A carrier device according to claim 1, wherein the first female connector has a U-shaped slot defined by a curved pocket and a pair of opposed channels which extend from the pocket, and wherein the first male connector has a plate slidably received by the U-shaped slot of the first female connector.

3. A carrier device according to claim 1, wherein the first male connector comprises a first plate coupled to the elongate mount, a second plate spaced-apart from the first plate, and a body which couples together the first plate and the second plate thereof.

4. A carrier device according to claim 3, wherein the first plate of the first male connector is circular, wherein the body of the first male connector is cylindrical and wherein the second plate of the first male connector is obround.

5. A carrier device according to claim 1, wherein the second male connector includes an elongate plate and wherein the second female connector includes a channel shaped to slidably receive and couple to the elongate plate of the second male connector.

6. A carrier device according to claim 1, wherein the elongate mount is shaped to selectively couple to and be slidably removable from the jacket via the first female connector and the first male connector.

7. A carrier device according to claim 1, wherein the second female connector includes a plate connectable to the input device and opposed channels coupled to and integrally formed with the plate thereof, wherein the second male connector has a width equal to or less than a distance of separation between the channels, and wherein the second male connector has a thickness equal to or less than a height of each said channel.

8. A carrier device according to claim 1, wherein the second male connector and the second female connector are configured to enable the input device to be slidably adjustable from a retracted position in which the input device is adjacent the jacket, to an extended position in which the input device is spaced-apart from the jacket.

9. A carrier device according to claim 1, including an adjustment mechanism enabling macro and micro adjustment of positioning of the second female connector relative to the elongate mount.

10. A carrier device according to claim 1, wherein the carrier device includes an adjustment mechanism comprising said threaded member and said plurality of longitudinally spaced-apart apertures extending through and positioned between proximal and distal ends of the elongate mount, the adjustment mechanism enabling macro positioning of the second female connector relative to the elongate mount within a range spanning between the proximal end and the distal end of the elongate mount, by positioning the second female connector in a desired position which aligns with a respective one of the apertures and thereafter fastening the threaded member through said respective one of the apertures so as to couple with the second female connector so macro positioned, and the adjustment mechanism enabling micro positioning of the second female connector relative to the elongate mount by incrementally adjusting positioning of the second female connector relative to the threaded member within a range spanning between a proximal end and a distal end of the second female connector and thereafter fastening the threaded member through said respective one of the apertures so as to couple with the second female connector so micro positioned.

11. A carrier device according to claim 1, wherein adjacent said apertures span a distance and wherein the second female connector has a length equal to or greater than half said distance between adjacent said apertures, thereby enabling micro adjustment of positioning of the second female connector relative to the elongate mount.

12. A carrier device according to claim 1, wherein the second elongate member of the elongate mount is planar in an upward-facing direction.

13. A carrier device according to claim 1, wherein the second elongate member of the elongate mount extends outwards from and is angled relative to the first elongate member of the elongate mount by an angle that is acute.

14. A carrier device according to claim 1, wherein the elongate mount is shaped to slidably couple to and be slidably removable from the input device via the second female connector and the second male connector.

15. A carrier device according to claim 6, wherein the elongate mount is shaped to slidably couple to and be slidably removable from the input device via the second female connector and the second male connector.

16. A carrier device according to claim 1, including adhesive via which the second female connector is connectable to the input device.

17. A carrier device according to claim 1, wherein the first elongate member of the elongate mount is selectively connectable to the jacket via a first portion thereof.

18. A carrier device according to claim 1, wherein the second elongate member of the elongate mount is shaped to be slidably received within channels of the second female connector.

19. A carrier device according to claim 1, wherein the second elongate member of the elongate mount is multiple times longer than the first elongate member of the elongate mount.

20. A carrier device according to claim 1, wherein the second elongate member of the elongate mount is at least three times longer than the first elongate member of the elongate mount.

* * * * *